US011688213B2

(12) United States Patent
DiCarlo et al.

(10) Patent No.: US 11,688,213 B2
(45) Date of Patent: Jun. 27, 2023

(54) TELEMATICS DATA PROCESSING FOR COLLISION DETECTION

(71) Applicant: Lyft, Inc., San Francisco, CA (US)

(72) Inventors: Michael Jonathan DiCarlo, El Dorado Hills, CA (US); Renee Hei-Kyung Park, San Francisco, CA (US); Alya Abbott, San Francisco, CA (US); Paul Alfred Dickinson, Oakland, CA (US); Desmond Mawuko Torkornoo, Oakland, CA (US); Akash Gaurav Shah, Millbrae, CA (US); Louis John Zell, San Francisco, CA (US); Preet Singh Anand, Oakland, CA (US)

(73) Assignee: Lyft, Inc., San Francisco, CA (US)

( * ) Notice: Subject to any disclaimer, the term of this patent is extended or adjusted under 35 U.S.C. 154(b) by 761 days.

(21) Appl. No.: 16/580,430

(22) Filed: Sep. 24, 2019

(65) Prior Publication Data

US 2021/0090358 A1 Mar. 25, 2021

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01); *G07C 5/085* (2013.01)

(58) Field of Classification Search
CPC ..... G07C 5/0808; G07C 5/008; G07C 5/085; G07C 5/0841
See application file for complete search history.

(56) References Cited

U.S. PATENT DOCUMENTS

| | | | | |
|---|---|---|---|---|
| 9,934,625 | B1 * | 4/2018 | Wahba | G07C 5/008 |
| 10,222,228 | B1 * | 3/2019 | Chan | G01C 21/3667 |
| 2019/0370760 | A1 * | 12/2019 | Kundu | G06Q 20/223 |

* cited by examiner

*Primary Examiner* — Michael V Kerrigan
(74) *Attorney, Agent, or Firm* — Keller Preece PLLC

(57) ABSTRACT

Methods and systems for processing telematics data are provided. In one embodiment, a method is provided that includes obtaining telematics information from a first device associated with a vehicle. The telematics information may indicate operations of the vehicle. An anomalous operation of the vehicle may then be determined based on the telematics information. The method may further include determining whether the anomalous operation of the vehicle is a vehicle collision. If the anomalous operation of the vehicle is a vehicle collision, routing information for the vehicle may be received that identifies previous locations of the vehicle. The routing information may then be compared with the telematics information to identify a location of the vehicle collision.

20 Claims, 13 Drawing Sheets

TELEMATICS DATA PROCESSING FOR COLLISION DETECTION

BACKGROUND

Transportation providers may cause one or more irregular and/or irrational vehicle operations. Such irregular and/or irrational vehicle operations may endanger the safety of a vehicle operator, nearby individuals, and/or other passengers of the vehicle. Telematics data may indicate one or more operational characteristics of a vehicle. For example, telematics data may indicate one or more of an acceleration, speed, and location of a vehicle.

SUMMARY

The present disclosure presents new and innovative system and methods for processing telematics data. In one embodiment, a method is provided comprising generating a task for a transportation provider vehicle in a dynamic transportation network and retrieving first telematics information from a computing device of the transportation provider vehicle based at least on the task. The method may also include identifying one or more anomalous operations of the transportation provider vehicle based at least on the first telematics information and generating a notification based at least on the one or more anomalous operations. The method may still further include transmitting the notification to the computing device to cause the computing device to display the notification.

In another embodiment, the method also includes determining the one or more anomalous operations indicates a collision associated with the transportation provider vehicle and retrieving second telematics information from one or more second computing devices located within a threshold distance from the transportation provider vehicle. The notification generated may indicate the collision with the transportation provider vehicle. Transmitting the notification may further comprise transmitting the notification indicating the collision to the one or more second computing devices to cause the one or more second computing devices to display the notification indicating the collision. The second telematics information from the second device may be received in compliance with a user setting associated with the second device (e.g., a user setting permitting access to the second telematics information).

In a further embodiment, the method also includes identifying the one or more anomalous operations of the transportation provider vehicle corresponds to one or more locations in completion of the task with the transportation provider vehicle and storing the one or more locations in association with the one or more anomalous operations of the transportation provider vehicle. The notification generated may comprise a warning notification identifying the one or more locations associated with the one or more anomalous operations. The method may also include transmitting the warning notification to the computing device in response to the transportation provider vehicle being located within a threshold distance from the one or more locations. The locations stored in association with the one or more anomalous operations of the transportation provider vehicle may be stored for a predetermined time period (e.g., a day, a week, a month) according to a user setting and may be deleted after the predetermined time period has passed.

In a still further embodiment, a method is provided comprising obtaining telematics information from a first device associated with a vehicle, the telematics information indicating operations of the vehicle. The telematics information from the first device may be received to comply with a user setting associated with the first device (e.g., a user setting permitting access to the telematics information). The method may further include determining, based on the telematics information, an anomalous operation of the vehicle and determining whether the anomalous operation of the vehicle is a vehicle collision. Responsive to determining the anomalous operation of the vehicle is a vehicle collision, the method may further include receiving routing information for the vehicle identifying previous locations of the vehicle and comparing the routing information with the telematics information to identify a location of the vehicle collision.

In another embodiment, the method further includes, responsive to determining the anomalous operation of the vehicle is not a vehicle collision, identifying a user profile associated with an operator of the vehicle and storing an indication of the anomalous operation of the vehicle, wherein the indication associates the anomalous operation of the vehicle with the user profile. The indication of the anomalous operation of the vehicle may be stored for a predetermined time period (e.g., a day, a week, a month) according to a user setting and may be deleted after the predetermined time period has passed.

In a further embodiment, comparing the routing information with the telematics information further includes identifying a collision indicator within the telematics information and correlating a time stamp of the collision indicator with the routing information.

In yet another embodiment, the method further includes receiving second telematics information from a second device associated with the vehicle and validating the telematics information from the first device with the second telematics information. The second telematics information from the second device may be received to comply with a user setting associated with the second device (e.g., a user setting permitting access to the second telematics information).

In a still further embodiment, validating the telematics information from the first device further includes correlating timing information of the telematics information received from the first device with timing information of the second telematics information received from the second device. The method may also include validating the anomalous operation of the vehicle by comparing the telematics information with the second telematics information.

In another embodiment, the method further includes determining whether the anomalous vehicle operation event is one or more of (i) a hard acceleration event, (ii) a hard braking event, (iii) a fast cornering event, and (iv) a device handling event during operation of the vehicle.

In a further embodiment, determining whether the anomalous vehicle operation event is a vehicle collision is performed by the first device.

In another embodiment, a system is provided comprising a processor and a memory. The memory may store instructions which, when executed by the processor, cause the processor to obtain telematics information from a first device associated with a vehicle, the telematics information indicating operations of the vehicle. The telematics information may be received from the first device in compliance with a user setting associated with the first device (e.g., a user setting permitting access to the telematics information). The memory may store further instructions which, when executed by the processor, may cause the processor to determine, based on the telematics information, an anomalous operation of the vehicle and determine whether the anomalous operation of the vehicle is a vehicle collision. The memory may store still further instructions which, when executed by the processor when the anomalous operation of the vehicle is a vehicle collision, may cause the processor to receive routing information for the vehicle identifying previous locations of the vehicle and compare the routing information with the telematics information to identify a location of the vehicle collision.

In yet another embodiment, the memory stores further instructions when, when executed by the process when the anomalous operation of the vehicle is not a vehicle collision, cause the processor to identify a user profile associated with an operator of the vehicle and store an indication of the anomalous operation of the vehicle, wherein the indication associates the anomalous operation of the vehicle with the user profile. The indication of the anomalous operation of the vehicle may be stored for a predetermined time period (e.g., a day, a week, a month) according to a user setting and may be deleted after the predetermined time period has passed.

In a further embodiment, the memory stores further instructions which, when executed by the processor while comparing the routing information with the telematics information, cause the processor to identify a collision indicator within the telematics information and correlate a time stamp of the collision indicator with the routing information.

In a still further embodiment, the memory stores further instructions which, when executed by the processor, cause the processor to receive second telematics information from a second device associated with the vehicle and validate the telematics information from the first device with the second telematics information.

In another embodiment, the memory stores further instructions which, when executed by the processor while validating the telematics information from the first device, cause the processor to correlate timing information of the telematics information received from the first device with timing information of the second telematics information received from the second device and validate the anomalous operation of the vehicle by comparing the telematics information with the second telematics information.

In yet another embodiment, the memory stores further instructions which, when executed by the processor, cause the processor to determine whether the anomalous vehicle operation event is one or more of (i) a hard acceleration event, (ii) a hard braking event, (iii) a fast cornering event, and (iv) a device handling event during operation of the vehicle.

In a further embodiment, the first device determines whether the anomalous vehicle operation event is a vehicle collision.

In a still further embodiment, a non-transitory, computer-readable medium is provided storing instructions which, when executed by a processor, cause the processor to obtain telematics information from a first device associated with a vehicle, the telematics information indicating operations of the vehicle. The telematics information may be received from the first device may be received to comply with a user setting associated with the first device (e.g., a user setting permitting access to the telematics information). The non-transitory, computer-readable medium may store further instructions which, when executed by the processor, cause the processor to determine, based on the telematics information, an anomalous operation of the vehicle and determine whether the anomalous operation of the vehicle is a vehicle collision. The non-transitory, computer-readable medium may store still further instructions which, when executed by the processor when the anomalous operation of the vehicle is a vehicle collision, may cause the processor to receive routing information for the vehicle identifying previous locations of the vehicle and compare the routing information with the telematics information to identify a location of the vehicle collision.

In another embodiment, the non-transitory, computer-readable medium stores further instructions when, when executed by the processor when the anomalous operation of the vehicle is not a vehicle collision, cause the processor to identify a user profile associated with an operator of the vehicle and store an indication of the anomalous operation of the vehicle, wherein the indication associates the anomalous operation of the vehicle with the user profile. The indication of the anomalous operation of the vehicle may be stored for a predetermined time period (e.g., a day, a week, a month) according to a user setting and may be deleted after the predetermined time period has passed.

In yet another embodiment, the non-transitory, computer-readable medium stores further instructions which, when executed by the processor while comparing the routing information with the telematics information, cause the processor to identify a collision indicator within the telematics information and correlate a time stamp of the collision indicator with the routing information.

In a further embodiment, the non-transitory, computer-readable medium stores further instructions which, when executed by the processor, cause the processor to receive second telematics information from a second device associated with the vehicle and validate the telematics information from the first device with the second telematics information. The second telematics information from the second device may be received to comply with a user setting associated with the second device (e.g., a user setting permitting access to the second telematics information).

In a still further embodiment, the non-transitory, computer-readable medium stores further instructions which, when executed by the processor while validating the telematics information from the first device, cause the processor to correlate timing information of the telematics information received from the first device with timing information of the second telematics information received from the second device and validate the anomalous operation of the vehicle by comparing the telematics information with the second telematics information.

In another embodiment, the non-transitory, computer-readable medium stores further instructions which, when executed by the processor, cause the processor to determine whether the anomalous vehicle operation event is one or more of (i) a hard acceleration event, (ii) a hard braking event, (iii) a fast cornering event, and (iv) a device handling event during operation of the vehicle.

The present disclosure also presents new and innovative system and methods for processing pre-stored telematics data. In one embodiment, a method is provided comprising obtaining telematics indicators indicating vehicle operations for one or more vehicles and, based on the telematics indicators, identifying anomalous vehicle operations corresponding to the one or more vehicles. The telematics indicators may be obtained in compliance with one or more user settings (e.g., user settings allowing access to the telematics indicators). The method may further include, based on historic routing information associated with the one or more vehicles, associating the anomalous vehicle operations with one or more locations and storing, for each location of the one or more locations, an indication of a particular anomalous vehicle operation of the anomalous vehicle operations. The indication may associate the anomalous vehicle operation with the location of the one or more locations.

In another embodiment, the method further includes identifying, based on the indication of the particular anomalous vehicle operation of a respective location of the one or more locations, a changed condition for the respective location and storing an indication of the changed condition in association with the respective location. The indication of the changed condition may be stored for a predetermined time period (e.g., a day, a week, a month) according to a user setting and may be deleted after the predetermined time period has passed.

In yet another embodiment, the changed condition includes one of a changed road quality condition at the respective location and a changed traffic condition at the respective location. An indication of the changed condition may also be stored in association with the respective location within a mapping database. The indication of the changed condition and/or the respective location may be stored for a predetermined time period (e.g., a day, a week, a month) according to a user setting and may be deleted after the predetermined time period has passed.

In a further embodiment, the method further includes receiving a request to generate a route between a first location and a second location and identifying, between the first location and the second location, one or more locations associated with one or more historical anomalous vehicle operations. The method may also include identifying, based on the one or more historical anomalous vehicle operations, a particular location, from the one or more locations, associated with the one or more historical anomalous vehicle operations and generating a route between the first location and the second location to avoid the particular location.

In a still further embodiment, the request to generate the route is received in connection with a request for transportation between the first location and the second location. Generating the route between the first location and the second location to avoid the particular location may further include determining that at least one of the first location and the second location is near the particular location and generating the route to include a starting location or destination location that avoids the particular location.

In another embodiment, the method further includes identifying an anomalous vehicle operation type associated with a user profile and receiving a request to generate a route for transportation by a vehicle operated by a user associated with the user profile. The anomalous vehicle operation type may be identified in compliance with a user setting associated with the user profile (e.g., a user setting permitting storage and/or accessing of anomalous vehicle operation information). The method may also include generating the route to avoid locations associated with anomalous vehicle operations corresponding to the anomalous vehicle operation type.

In yet another embodiment, the method further comprises receiving current telematics information regarding operation of a vehicle associated with a user profile and comparing the current telematics information with historical telematics indicators associated with the user profile. The method may also include determining that the current telematics information differs from the historical telematics indicators and determining that the vehicle is not operated by a user associated with the second user profile.

In a further embodiment, a system is provided comprising a processor and a memory. The memory may store instructions which, when executed by the processor, cause the processor to obtain telematics indicators indicating vehicle operations for one or more vehicles and, based on the telematics indicators, identify anomalous vehicle operations corresponding to the one or more vehicles. The telematics indicators may be obtained in compliance with one or more user settings (e.g., user settings allowing access to the telematics indicators). The memory may store further instructions which, when executed by the processor, cause the processor to, based on historic routing information associated with the one or more vehicles, associate the anomalous vehicle operations with one or more locations and store, for each location of the one or more locations, an indication of a particular anomalous vehicle operation of the anomalous vehicle operations, wherein the indication associates the anomalous vehicle operation with the location of the one or more locations.

In a still further embodiment, the memory stores further instructions which, when executed by the processor, cause the processor to identify, based on the indication of the particular anomalous vehicle operation of a respective location of the one or more locations, a changed condition for the respective location and store an indication of the changed condition in association with the respective location. The indication of the changed condition may be stored for a predetermined time period (e.g., a day, a week, a month) according to a user setting and may be deleted after the predetermined time period has passed.

In another embodiment, the changed condition includes one of a changed road quality condition at the respective location and a changed traffic condition at the respective location. The memory may also store further instructions which, when executed by the processor, cause the processor to store an indication of the changed condition in association with the respective location within a mapping database. The indication of the changed condition and/or the respective location may be stored for a predetermined time period (e.g., a day, a week, a month) according to a user setting and may be deleted after the predetermined time period has passed.

In yet another embodiment, the memory stores further instructions which, when executed by the processor, cause the processor to receive a request to generate a route between a first location and a second location and identify, between the first location and the second location, one or more locations associated with one or more historical anomalous vehicle operations. The memory may store still further instructions which, when executed by the processor, cause the processor to identify, based on the one or more historical anomalous vehicle operations, a particular location, from the one or more locations, associated with the one or more historical anomalous vehicle operations and generate a route between the first location and the second location to avoid the particular location.

In a further embodiment, the request to generate the route is received in connection with a request for transportation between the first location and the second location. The memory may also stores further instructions which, when executed by the processor while generating the route between the first location and the second location to avoid the particular location, cause the processor to determine that at least one of the first location and the second location is near the particular location and generate the route to include a starting location or destination location that avoids the particular location.

In a still further embodiment, the memory stores further instructions which, when executed by the processor, cause the processor to identify an anomalous vehicle operation type associated with a user profile and receive a request to generate a route for transportation by a vehicle operated by a user associated with the user profile. The anomalous vehicle operation type may be identified in compliance with a user setting associated with the user profile (e.g., a user setting permitting storage and/or accessing of anomalous vehicle operation information). The memory may store still further instructions which, when executed by the processor, cause the processor to generate the route to avoid locations associated with anomalous vehicle operations corresponding to the anomalous vehicle operation type.

In another embodiment, the memory stores further instructions which, when executed by the processor, cause the processor to receive current telematics information regarding operation of a vehicle associated with a user profile and compare the current telematics information with historical telematics indicators associated with the user profile. The memory may store still further instructions which, when executed by the processor, cause the processor to determine that the current telematics information differs from the historical telematics indicators and determine that the vehicle is not operated by a user associated with the second user profile.

In yet another embodiment, a non-transitory, computer-readable medium is provided storing instructions which, when executed by a processor, cause the processor to obtain telematics indicators indicating vehicle operations for one or more vehicles. The telematics indicators may be obtained in compliance with a user setting (e.g., a user setting permitting access to the telematics indicators). The non-transitory, computer-readable medium may store further instructions which, when executed by the processor, cause the processor to, based on the telematics indicators, identify anomalous vehicle operations corresponding to the one or more vehicles and, based on historic routing information associated with the one or more vehicles, associate the anomalous vehicle operations with one or more locations. The non-transitory, computer-readable medium may store still further instructions which, when executed by the processor, cause the processor to store, for each location of the one or more locations, an indication of a particular anomalous vehicle operation of the anomalous vehicle operations, wherein the indication associates the anomalous vehicle operation with the location of the one or more locations. The indication of the particular anomalous vehicle operation may be stored for a predetermined time period (e.g., a day, a week, a month) according to a user setting and may be deleted after the predetermined time period has passed.

In a further embodiment, the non-transitory, computer-readable medium stores further instructions which, when executed by the processor, cause the processor to identify, based on the indication of the particular anomalous vehicle operation of a respective location of the one or more locations, a changed condition for the respective location and store an indication of the changed condition in association with the respective location. The indication of the changed condition may be stored for a predetermined time period (e.g., a day, a week, a month) according to a user setting and may be deleted after the predetermined time period has passed.

In a still further embodiment, the changed condition includes one of a changed road quality condition at the respective location and a changed traffic condition at the respective location. The non-transitory, computer-readable medium may also store further instructions which, when executed by the processor, cause the processor to store an indication of the changed condition in association with the respective location within a mapping database. The indication of the changed condition and/or the respective location may be stored for a predetermined time period (e.g., a day, a week, a month) according to a user setting and may be deleted after the predetermined time period has passed.

In another embodiment, the non-transitory, computer-readable medium stores further instructions which, when executed by the processor, cause the processor to receive a request to generate a route between a first location and a second location and identify, between the first location and the second location, one or more locations associated with one or more historical anomalous vehicle operations. The non-transitory, computer-readable medium may store still further instructions which, when executed by the processor, cause the processor to identify, based on the one or more historical anomalous vehicle operations, a particular location, from the one or more locations, associated with the one or more historical anomalous vehicle operations and generate a route between the first location and the second location to avoid the particular location.

In yet another embodiment, the request to generate the route is received in connection with a request for transportation between the first location and the second location. The non-transitory, computer-readable medium may also store further instructions which, when executed by the processor while generating the route between the first location and the second location to avoid the particular location, cause the processor to determine that at least one of the first location and the second location is near the particular location and generate the route to include a starting location or destination location that avoids the particular location.

In a further embodiment, the non-transitory, computer-readable medium stores further instructions which, when executed by the processor, cause the processor to identify an anomalous vehicle operation type associated with a user profile and receive a request to generate a route for transportation by a vehicle operated by a user associated with the user profile. The anomalous vehicle operation type may be identified in compliance with a user setting associated with the user profile (e.g., a user setting permitting storage and/or accessing of anomalous vehicle operation information). The non-transitory, computer-readable medium may store still further instructions which, when executed by the processor, cause the processor to generate the route to avoid locations associated with anomalous vehicle operations corresponding to the anomalous vehicle operation type.

The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the disclosed subject matter.

DETAILED DESCRIPTION OF EXAMPLE EMBODIMENTS

Figure 1:
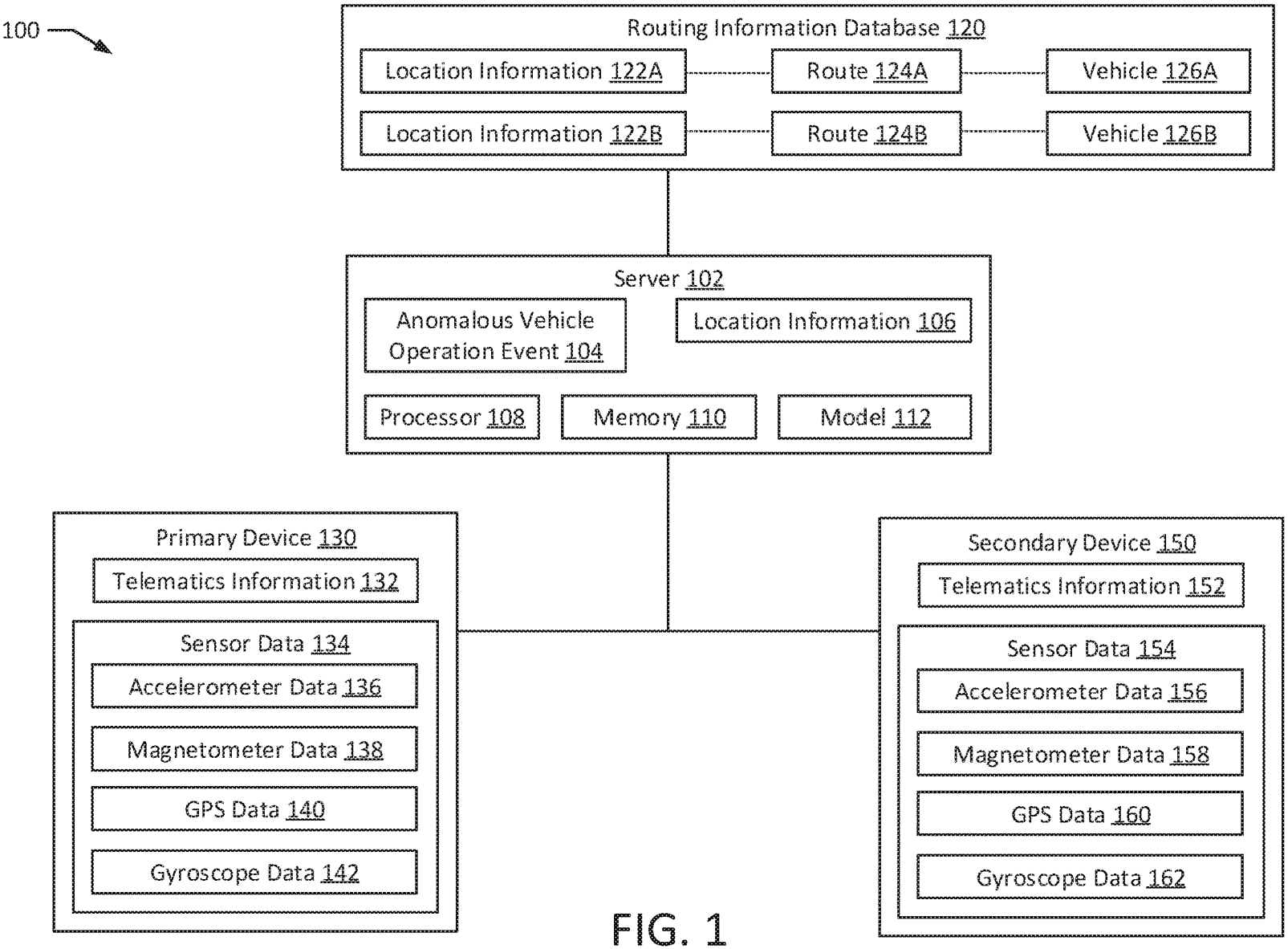
FIG. 1 illustrates a system according to an exemplary embodiment of the present disclosure.

Aspects of the present disclosure involve processing or otherwise analyzing telematics data to evaluate operations of a vehicle. For example, telematics data may be processed to detect irregular and/or irrational operations of the vehicle. In other instances, telematics data may be processed to evaluate a skill level and/or safety level of a given set of operations performed by the vehicle when under the control of a vehicle operator or transportation provider. For example, a transportation networking company (TNC) may process telematics data to evaluate vehicle operators operating vehicles on behalf of the TNC or vehicle operators operating vehicles provided by the TNC.

In some instances, TNCs may implement a transportation system that matches transportation requests with a dynamic transportation network of vehicles. The transportation system may communicate with computing devices associated with the vehicles in the network. For example, the transportation system may generate one or more tasks (e.g., an instruction to access a vehicle, an instruction to maneuver a vehicle to a specific location such as a starting location or destination location, an instruction to wait or remain in a specific location, or any other operation that may be performed in connection with the TNC) for transmission to the computing devices associated with the vehicles in the network for performance by the vehicle. In certain instances, the vehicles may include road-going vehicles and personal mobility vehicles. In some examples, some of the vehicles may be standard commercially available vehicles and some of the vehicles may be owned and/or operated by individuals. In some implementations, the vehicles may additionally or alternatively be autonomous (or partly autonomous). Accordingly, throughout the instant disclosure, references to a "vehicle operator" (or an "operator") may, where appropriate, refer to a human driving a vehicle, an autonomous vehicle control system, an autonomous vehicle, an owner of an autonomous vehicle, an operator of an autonomous vehicle, an attendant of an autonomous vehicle, a requesting user piloting a vehicle, and/or an autonomous system for piloting a vehicle. In one example, the TNC may implement multiple transportation systems, where each transportation system is responsible for coordinating transportation matching for a region or set number of vehicles.

The transportation system may communicate with computing devices associated with the vehicles, which may be separate computing devices and/or may be integrated into the respective vehicles. In some examples, one or more of the computing devices may be mobile devices, such as a smart phone. Additionally or alternatively, one or more of the computing devices may be tablet computers, personal digital assistants, or any other type or form of mobile computing device. According to some examples, one or more of the computing devices may include wearable computing devices (e.g., a wearable computing device), such as smart glasses, smart watches, etc. In some examples, one or more of the computing devices may be devices suitable for temporarily mounting in a vehicle (e.g., for use by a requestor and/or a vehicle operator for a transportation matching application, a navigation application, and/or any other application suited for use by requestors and/or operators). Additionally or alternatively, one or more of the computing devices may be devices suitable for installing in a vehicle and/or may be a vehicle's computer that has a transportation management system application installed on the computer to provide transportation services to transportation requestors and/or communicate with the transportation system.

Additionally, the transportation matching system may communicate with user devices requesting transportation. In some examples, the user devices requesting transportation may include a requestor app implemented by the transportation provider. The requestor app may represent any application, program, and/or module that may provide one or more services related to requesting transportation services. For example, the requestor app may include a transportation matching application for requestors. In some examples, the requestor app may match the user of the requestor app (e.g., a transportation requestor) with transportation operators through communication with the transportation system. In addition, the requestor app may provide the transportation system with information about a requestor (including, e.g., the current location of the requestor) to enable the transportation system to provide dynamic transportation matching services for the requestor and one or more providers. In some examples, the requestor app may coordinate communications and/or a payment between a requestor and a provider. According to some embodiments, the requestor app may provide a map service, a navigation service, a traffic notification service, and/or a geolocation service.

The transportation system may arrange transportation on an on-demand and/or ad-hoc basis by, e.g., matching one or more transportation requestors with one or more transportation providers. For example, a transportation matching system may provide one or more transportation matching services for a networked transportation service, a ridesourcing service, a taxicab service, a car-booking service, an autonomous vehicle service, a personal mobility vehicle service, or some combination and/or derivative thereof. The transportation system may include and/or interface with any of a variety of subsystems that may implement, support, and/or improve the transportation matching service. For example, the transportation matching system may include a matching system (e.g., that matches requestors to ride opportunities and/or that arranges for requestors and/or providers to meet), a mapping system, a routing system (e.g., to help a provider reach a requestor, to help a requestor reach a provider, and/or to help a provider reach a destination), a rating system (e.g., to rate and/or gauge the trustworthiness of a requestor and/or a provider), a payment system, and/or an autonomous or semi-autonomous driving system. The transportation matching system may be implemented on various platforms, including a requestor-owned mobile device, a computing system installed in a vehicle, a server computer system, or any other hardware platform capable of providing transportation matching services to one or more requestors and/or providers.

Telematics data regarding operation of the vehicle may be obtainable from mobile devices within the vehicle. For example, sensor data may be received from a mobile device within a vehicle when authorized to receive such sensor data by a user associated with the mobile device. That sensor data may include information such as accelerometer data, magnetometer data, GPS data, and gyroscope data. In certain implementations, the sensor data may need to be calibrated to accurately reflect operation of the vehicle. For example, the frame of reference for the accelerometer data of the mobile device may not align with the frame of reference of the vehicle. Accordingly, such sensor data may be initially calibrated in order to accurately orient sensor data from the mobile device to accurately represent operating conditions of the vehicle.

Telematics data regarding operation of the vehicle may similarly be received from one or more fixed sensor devices located on the vehicles, e.g., when authorized to do so by users associated with the vehicles. For example, certain types of vehicles such as cars that are part of a fleet may have sensor modules affixed in an unchanging orientation relative to the vehicle. In other examples, certain types of vehicles, such as autonomous cars, scooters, and/or bicycles may have built-in sensors configured to capture telematics information regarding operation of the vehicles. In such implementations, because the orientation of the sensors relative to the vehicles may not change, the sensor data may not have to be calibrated as frequently.

Telematics data received from any of these types of sensors (e.g., when authorized to do so by users associated with the vehicles) may be used to make determinations regarding operation of an associated vehicle. However, the received telematics data from such sensors may not always accurately represent operation of the vehicle. For example, the sensors may be susceptible to noise or other degradation issues that impact the quality of the telematics data received from such sensors. Further, where the orientation of sensors may change relative to the vehicle (e.g., where sensor data is received from a mobile device), a change in orientation may lead to inaccuracies in the received telematics data. Therefore, there exists a need to verify received telematics data, especially where the received telematics data indicates vehicle operation irregularities.

One solution to these problems is to validate received telematics data with information from another source. In a first example, the information from another source may include further telematics information received from another device associated with the vehicle, e.g., when authorized to do so by a user associated with the other device. For example, further sensor data may be received and processed from a second mobile device associated with the vehicle. In another example, the received telematics data may be compared to other, similar telematics data. In particular, where the received telematics data indicates an anomalous vehicle operation event, the received telematics data may be compared to previous, similar anomalous vehicle operation event in order to determine whether the particular anomalous vehicle operation event is severe or otherwise indicative of irregular and/or irrational vehicle operation. Furthermore, where it is determined that the received telematics information indicates a potential vehicle collision, additional intervention steps may be taken, such as assisting with accident reporting and data collection and contacting emergency services.

Also, previously-stored telematics data may be used to perform certain types of evaluations. For example, previously-stored telematics data may be correlated with certain locations or road segments to identify dangerous and/or congested locations that should be avoided by vehicle operators. Previously-stored telematics data may also be used to make determinations regarding vehicle operators. For example, the telematics data may be associated with user profiles to identify types of anomalous vehicle operation events with which the user profile is frequently associated. Subsequent routes generated for use by the user profile may be generated to avoid locations associated with such types of anomalous vehicle operation events. Additionally, previously-stored telematics data associated with a user profile may be compared to current telematics information associated with the user profile to determine whether a user associated with the user profile is actually operating the vehicle. Any storage and analysis performed involving previously-stored telematics data may be performed in compliance with one or more user settings created by users associated with the previously-stored telematics data. For example, the user settings may specify a predetermined period of time (e.g., one day, one week, one month, three months) for which the previously-stored telematics data may be maintained in storage. After the predetermined period of time, the previously-stored telematics data may be deleted. In another example, the user settings may specify one or more operations that cannot be performed using the previously-stored telematics data. In such implementations, the specified operations will not be performed using the previously-stored telematics data.

FIG. 1 depicts a system 100 according to an exemplary embodiment of the present disclosure. The system 100 may be configured to receive and verify telematics information from various devices associated with a vehicle. The system 100 includes a server 102 communicatively coupled to a primary device 130, a secondary device 150, and routing information 120. The primary device 130 may be configured to collect sensor data 134, including accelerometer data 136, magnetometer data 138, global positioning system (GPS) data 140, and/or gyroscope data 142. For example, the primary device 130 may include one or more sensors (e.g., an accelerometer, magnetometer, GPS sensor, and gyroscope) configured to collect the sensor data 134. Although not depicted, the primary device 130 may also include other types of sensors, which may be readily apparent to those skilled in the art based on the present disclosure. The sensor data 134 may be collected in compliance with one or more user settings (e.g., user settings authorizing collection of the sensor data 134 for telematics purposes).

The primary device 130 may be associated with a vehicle and may be configured to convert the sensor data 134 into telematics information 132 regarding operation of the vehicle. For example, the primary device 130 may be a mobile device located within the vehicle (e.g., associated with an operator of the vehicle). In another example, the primary device 130 may be a sensor module affixed to the vehicle, or built into the vehicle. However, in certain implementations, the frame of reference of the sensors of the primary device 130 may not align with the frame of reference of the vehicle. In such instances, the sensor data may not properly reflect operation of the vehicle. Therefore, the sensor data 134 may need to be adjusted to accurately represent operation of the vehicle. Further, one or more types of collected sensor data 134 may be combined to generate the telematics information 132. For example, accelerometer data 136 from an accelerometer sensor may be susceptible to small changes in acceleration (e.g., bumps in the road, small movements of the primary device 130), which may cause the accelerometer data 136 to inaccurately reflect operation of the vehicle. Similarly, GPS data 140 may show changes in speed, thereby indicating a rough estimate of an acceleration of the vehicle; however, the GPS data 140 may not include data that was generated at a high enough frequency to enable subsequent processing. Accordingly, in certain implementations, the accelerometer data 136 and the GPS data 140 may be combined during generation of the telematics information 132 according to one or more telematics information generating processes, to generate a dataset of acceleration data corresponding to the vehicle that is more accurate, and which is generated at a high enough frequency for subsequent processing. Similar techniques for generating the telematics information 132 may combine data from other types of sensors, such as the magnetometer data 138 and the gyroscope data 142.

The secondary device 150 may also collect sensor data 154 including one or more of accelerometer data 156, magnetometer data 158, GPS data 160, and gyroscope data 162. For example, the secondary device may collect or otherwise receive telematics signals, information, and/or data when located a threshold distance from the vehicle. As with the primary device 130, the secondary device 150 may include one or more sensors, including an accelerometer, a magnetometer, a GPS sensor, and gyroscope sensor, along with further sensors which may not be depicted. The secondary device 150 may be configured to convert the sensor data 154 for the telematics information 152 according to techniques similar to those discussed above. In certain implementations, the secondary device 150 may be a mobile device associated with the vehicle. In one specific example, the secondary device may be a mobile device associated with an individual located within the vehicle who is not the vehicle operator. In other implementations, the secondary device 150 may be a sensor module affixed to or built into the vehicle. In certain implementations, the primary device 130 or the secondary device 150 may be implemented by the same type of device. For example, both the primary device 130 and the secondary device 150 may be mobile devices. In other implementations, the primary device 130 and the secondary device 150 may be implemented as different types of devices. For example, the primary device 130 may be a sensor array affixed to the vehicle and the secondary device 150 may be a mobile device associated with the vehicle. In such implementations, the secondary device 150 may be associated with the operator of a vehicle, or may be associated with an individual located within the vehicle who is not the vehicle operator. The sensor data 154 may be collected in compliance with one or more user settings (e.g., user settings authorizing collection of the sensor data 154 for telematics purposes).

The server 102 may be configured to receive telematics information 132 from the primary device 130 indicating the current operation of the vehicle. In particular, the server 102 may be configured to receive telematics information 132 from the primary device 130 in compliance with a user setting associated with the primary device 130 (e.g., a user setting permitting access to telematics information 132). Based on the telematics information 132, the server 102 may identify anomalous vehicle operation events 104 (e.g., identifying irregular and/or irrational vehicle operations that deviate from vehicle operations considered standard, normal, or expected under typical usage scenarios). For example, the server 102 may analyze the telematics information 132 received from the primary device 130 according to one or more processing techniques to identify an anomalous vehicle operation event 104. In other examples, such processing may be performed by the primary device 130. For example, prior to transmitting the telematics information 132, the primary device 130 may analyze the telematics information 132 according to the one or more processing techniques to identify the anomalous vehicle operation events 104.

In one specific example, anomalous vehicle operation events 104 may represent potentially irregular and/or irrational vehicle operations, such as braking events (e.g., hard braking, sudden braking, sudden deceleration, sudden stopping) acceleration events (e.g., hard acceleration events, sudden acceleration, sudden starting), speeding events (e.g., proceeding at a high speed or a speed exceeding a speed limit, sudden speeding, sustained speeding), steering events (e.g., fast cornering events, sudden overtaking, sudden lane changes, sudden turning and cornering), and irrational phone handling during vehicle operation. In one example, the anomalous vehicle operation events 104 may represent the initial estimates of telematics information 132 that may correspond to such potentially irregular and/or irrational vehicle operations. For example, to reduce processing complexity and increase responsiveness, the anomalous vehicle operation events 104 may be identified according to comparatively simpler processing techniques, such as one or more processing heuristics for the telematics information 132. This simplified processing may enable, e.g., faster processing of telematics information 132 by the server 102. In other implementations, when the primary device 130 is performing the processing, the simplified processing techniques may enable the primary device 130 to perform such processing without adversely affecting battery life, resource utilization, and other processing of the primary device 130. Such processing techniques are discussed further below in connection with FIGS. 2A-2C. In certain implementations, the anomalous vehicle operation event 104 may include one or more of: telematics information associated with a detected irregular and/or irrational driving event; timing information regarding the irregular and/or irrational driving event; and/or location information for the irregular and/or irrational driving event. In further implementations, the anomalous vehicle operation event 104 may also include an operation type indicating an initial estimate of the type of vehicle operation that gave rise to detection of the anomalous vehicle operation event 104.

In some instances, the server 102 may be configured to further process anomalous vehicle operation events 104 to determine whether the anomalous vehicle operation corresponds to an actual irregular and/or irrational vehicle operation. Because the server 102 only performs such further processing on anomalous vehicle operation events, the processing techniques may be more rigorous without adversely impacting overall system responsiveness. For example, the server 102 may receive additional information regarding operation of the vehicle in order to verify the anomalous vehicle operation events detected within the telematics information 132. In certain implementations, the server 102 may receive further telematics information 152 from the secondary device 150. In particular, the server 102 may receive telematics information 152 from the secondary device 150 in compliance with a user setting associated with the secondary device 150 (e.g., a user setting permitting access to the telematics information 152). The server 102 may then analyze the telematics information 152 for further detail regarding the anomalous vehicle operation event 104. For example, the server 102 may correlate timing information of the telematics information 132 with timing information of the telematics information 152 and may determine whether the anomalous vehicle operation event 104 is reflected in the telematics information 152.

In additional or alternative implementations, the server 102 may compare the received telematics information 132 with other location information 106 corresponding to operation of the vehicle. For example, the location information 106 may include routing information for the vehicle. Such routing information may include routes taken by the vehicle prior to the anomalous vehicle operation event 104 and/or a planned route to be followed by the vehicle after the anomalous vehicle operation of 104. For example, where processing of the anomalous vehicle operation event 104 happens in real time during operation of the vehicle, the routing information may include an intended destination (e.g., a pick up or drop off location) and/or a planned route to the intended destination. The location information 106 may also include road information regarding roads and/or cross roads (e.g., intersections) near the location of the vehicle at the time of the anomalous vehicle operation event 104. The road information may include driving restrictions (e.g., one-way roads, turn restrictions, stop signs, other traffic flow or vehicle operation considerations) on the nearby roads. In certain implementations, the road information may further include details regarding other anomalous vehicle operation events 104 that occurred on nearby roads. For example, the road information may indicate or provide other information regarding, e.g., collisions or potential vehicle collisions on the nearby roads.

In certain implementations, the server 102 may generate various notifications (e.g., a warning or alert) for display, such as at the primary device 130, the secondary device 150, and/or the like. The notifications may include or otherwise identify the location information (e.g., location information 106, 122A, and/or 122B) and any corresponding anomalous vehicle operation events 104. In some instances, the notifications may be transmitted for display when the primary device 130 and/or the secondary device 150 are within a certain threshold distance from the locations identified within the location information 106, 122A, and/or 122B. The notifications may be generated in compliance with a user setting (e.g., a user setting associated with one or both of the primary device 130 and the secondary device 150 allowing or prohibiting the notifications to be generated).

In certain implementations, the server 102 may process the anomalous vehicle operation event 104 using a model 112. For example, the model 112 may be configured to determine whether the anomalous vehicle operation event 104 corresponds to a potential vehicle collision. In particular, the model 112 may be configured to identify a collision indicator within the telematics information 132 and to correlate the collision indicator with the location information 106. In certain implementations, the model 112 may be configured to predict a location of a potential vehicle collision based on this correlation. In other examples, the model 112 may be configured to determine whether the anomalous vehicle operation event 104 corresponds to other types of irregular and/or irrational vehicle operations (e.g., hard braking events, hard cornering events, hard acceleration events, speeding events, and phone handling during vehicle operation). For example, the model 112 may be configured to combine and/or compare the telematics information 132 and the telematics information 152 to further analyze the anomalous vehicle operation event 104. Such implementations are discussed in further detail below.

The routing information database 120 may be configured to store location information 122A-B. In particular, the routing information database 120 may store the location information 106 utilized by the server 102 when analyzing the anomalous vehicle operation event 104. For example, the routing information database 120 may store the location information 122A-B in association with one or more routes 124A-B. The routes 124A-B may correspond to one or more vehicles 126A-B providing transportation in connection with the routes 124A-B. The routes 124A-B may specify a starting and ending location, and the location information 122A-B may specify routing information between the starting and ending location (e.g., information regarding the route taken prior to the time of the anomalous vehicle operation event 104 and/or information regarding an intended routes to be taken after the time of the anomalous vehicle operation event 104). To access the location information 106 for subsequent processing, the server 102 may specify the vehicle corresponding to the telematics information 132, and may identify the vehicle 126A-B from the routing information database 120 corresponding to the vehicle. The server 102 may then retrieve the location information 122A-B corresponding to the identified vehicle 126A-B. In certain implementations, the server 102 may also receive the route 124A-B from the routing information database 120.

In still further implementations, the routing information database 120 may be used to identify the secondary device 150. For example, the routes 124A-B may store information regarding a user who requested the route (e.g., who requested transportation between the starting location in the ending location). The routes 124A-B may also identify the secondary device 150 associated with the user, which may then be used to request the telematics information 152.

Any information stored by the routing information database 120 may be stored in accordance with one or more user settings (e.g., user settings associated with user profiles corresponding to the routes 124A-B). For example, the user settings may specify a predetermined period of time (e.g., a day, a week, a month) for which the information can be stored. After the predetermined period of time has passed, the information may be deleted from the routing information database 120 in compliance with the user settings.

One or more of the server 102, the primary device 130, the secondary device 150, and the routing information database 120 may be implemented by one or more computing devices. For example, the processor 108 and the memory 110 may implement one or more operational features of the server 102. In particular, the memory 110 may store instructions which, when executed by the processor 108, may implement one or more operational features of the server 102. Additionally, although not depicted, one or more of the primary device 130, the secondary device 150, and the routing information database 120 may similarly contain a processor and a memory that implement one or more operational features.

Figure 2A:
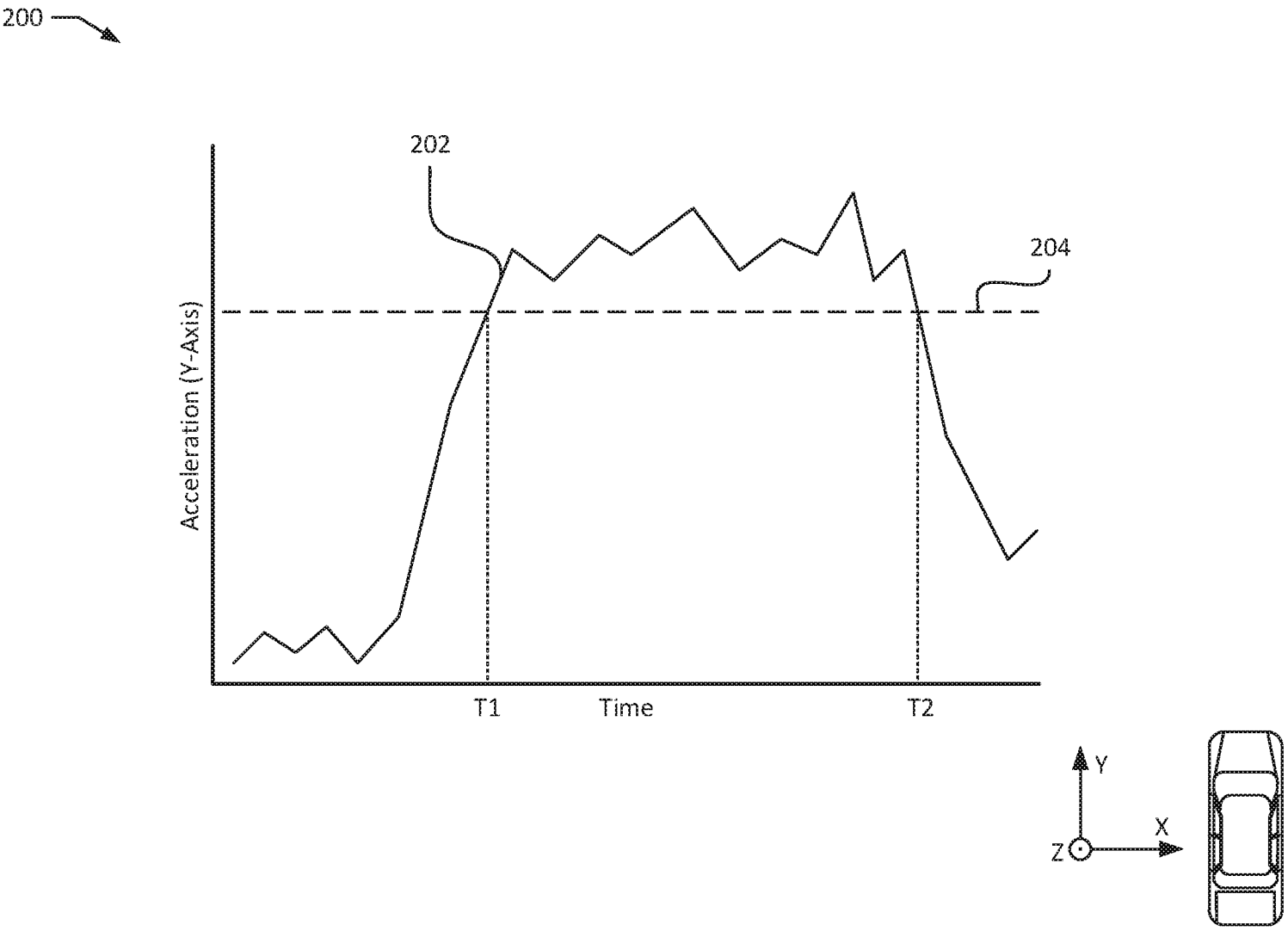
FIGS. 2A-2C illustrate telematics processing operations according to exemplary embodiments of the present disclosure.
Figure 2B:
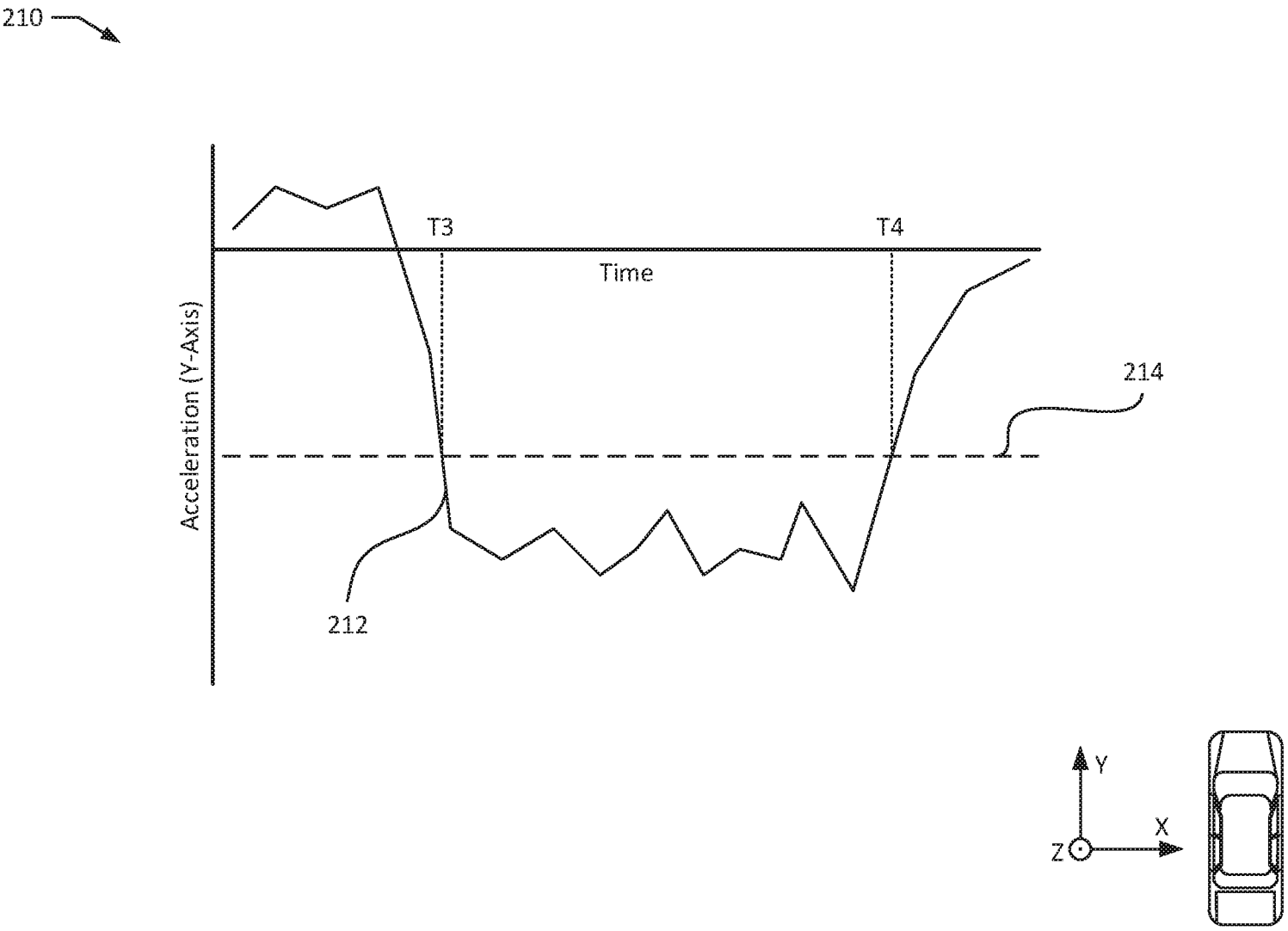
Figure 2C:
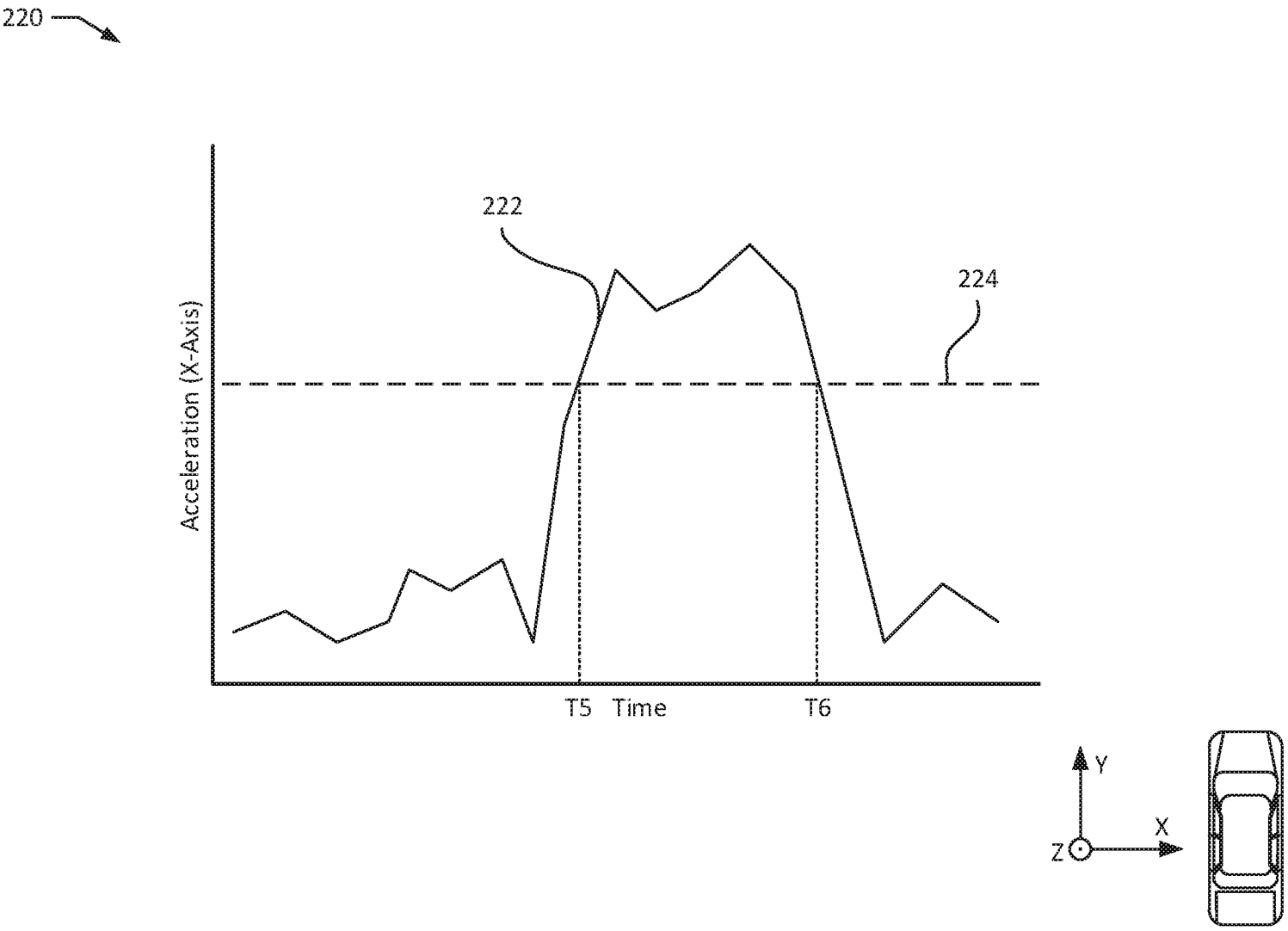

FIGS. 2A-2C depict telematics processing operations 200, 210, 220 according to exemplary embodiments of the present disclosure. The telematics processing operations 200, 210, 220 may be performed by one or both of the server 102 and the primary device 130 to identify anomalous vehicle operation events 104 and the telematics information 132.

Referring initially to FIG. 2A, the telematics processing operation 200 includes acceleration data 202 for a vehicle in the Y axis. As shown in the accompanying legend, the Y-axis acceleration corresponds to acceleration or deceleration in the direction of movement of the vehicle. The acceleration data 202 begins with low acceleration, but rises shortly before time T1. The acceleration data 202 remains high for a duration of time extending from time T1 to T2, before decreasing again. As depicted, the acceleration data 202 depicts a period of acceleration in the positive Y direction, which may correspond to acceleration of the vehicle in the forward direction. As explained above, a sudden, hard increase in acceleration may be considered an irregular and/or irrational driving event potentially worth monitoring by the system 100. Accordingly, if the acceleration data 202 indicates that the vehicle is accelerating too quickly, the acceleration event may be identified as an anomalous vehicle operation event 104 worthy of further processing. Any further processing or monitoring of irregular or irrational driving events may be performed to comply with one or more user settings. For example, the further processing or monitoring may be performed to comply with a user setting associated with the primary device 130 and/or a user setting associated with the secondary device 150. In certain instances, the user settings may indicate that monitoring and detection of irregular or irrational driving events is permitted (e.g., is always permitted, is permitted for a certain amount of time). In such instances, the system 100 may monitor for irregular or irrational driving events, such as an acceleration event, as discussed above. In other instances, the user settings may indicate that monitoring and detection of irregular or irrational driving events is forbidden. In such instances, the system 100 will not monitor for irregular or irrational driving events.

To identify the potential anomalous vehicle operation event 104, the telematics processing operation 200 may apply a threshold 204. Acceleration above the threshold 204 may be identified as an irregular or irrational acceleration event and may therefore be considered an anomalous vehicle operation event 104. As depicted, the acceleration data 202 remains above the threshold 204 for a duration extending from time T1 to time T2. Accordingly, the server 102 and/or the primary device 130 may identify an anomalous vehicle operation event 104 based on the acceleration data 202 from time T1 to time T2. In certain implementations, in order for an anomalous vehicle operation event 104 to be identified, it may be required that the acceleration data 202 remain above the threshold 204 for certain period of time (e.g., one second, 0.5 seconds, 0.25 seconds). Accordingly, the server 102 and/or the primary device 130 may compute a time difference from time T1 to time T2 prior to identifying the anomalous vehicle operation event 104 to ensure that the duration exceeds the required amount of time.

Referring to FIG. 2B, the telematics processing operation 210 also depicts acceleration data 212 in the Y axis of the vehicle. As depicted, the acceleration data 212 begins slightly positive, before decreasing to a negative value prior to time T3. The acceleration data 212 remains more negative from time T3 to time T4 before increasing to a slightly negative value. As explained above, sudden, hard deceleration may be identified as an irregular and/or irrational driving event that is potentially worth monitoring by the system 100. Accordingly, if the acceleration data 212 indicates that the vehicle is breaking too quickly, the deceleration event may be identified as an irregular and/or irrational driving event potentially worth monitoring. As explained above, any monitoring or further processing of irregular and/or irrational driving events may be performed subject to user settings associated with the primary device 130 and/or the secondary device 150. In particular, if a user setting associated with either the primary device 130 or the secondary device 150 indicates that monitoring for irregular and/or irrational driving events is forbidden, the system 100 will not monitor for irregular and/or irrational driving events such as deceleration events.

To detect deceleration events, the telematics processing operation 210 may apply a threshold 214 to identify anomalous vehicle operation events 104. If the acceleration data 212 extends below the threshold 214, and anomalous vehicle operation event 104 may be identified. As depicted, the acceleration data 212 extends below the threshold 214 from time T3 to time T4. Accordingly, the server 102 and/or primary device 130 may identify an anomalous vehicle operation event 104 from time T3 to time T4. As with the telematics processing operation 200, the telematics processing operation 210 may also require that the acceleration data 212 extend below the threshold 214 for a certain period of time (e.g., one second, 0.5 seconds, 0.25 seconds). The server 102 and/or the primary device 130 may accordingly compute the duration from time T3 to time T4 prior to identifying an anomalous vehicle operation event 104 to ensure that the duration exceeds the required amount of time.

Referring now to FIG. 2C, the telematics processing operation 220 depicts acceleration data 222 in the X axis of the vehicle, indicating that the vehicle is possibly moving across lanes, taking sharp turns, cornering, etc. As depicted, the acceleration data 222 begins at relatively low values before increasing shortly before time T5 to higher, positive values. The acceleration data 222 remains at the higher positive values from time T5 to time T6, and then returns to the relatively low values. As discussed above, taking turns quickly (e.g., fast cornering events) may be considered potentially irregular and/or irrational driving events worth monitoring by the system 100. As explained above, any monitoring or further processing of irregular and/or irrational driving events may be performed subject to user settings associated with the primary device 130 and/or the secondary device 150. In particular, if a user setting associated with either the primary device 130 or the secondary device 150 indicates that monitoring for irregular and/or irrational driving events is forbidden, the system 100 will not monitor for irregular and/or irrational driving events such as fast cornering events.

Quick turns generate centripetal acceleration along the X direction of the vehicle that varies according to the speed of the turn. Accordingly, the X-axis acceleration data 222 may be used to detect such fast cornering events. For example, the telematics processing operation 220 may identify anomalous vehicle operation events 104 by applying a threshold 224. Acceleration above the threshold 224 may indicate a fast cornering event that may be considered an anomalous vehicle operation event 104. In particular, the acceleration data 222 exceeds the threshold 224 from time T5 to time T6, which the system may identify as a fast cornering event and thereby an anomalous vehicle operation event 104. As with the telematics processing operations 200, 210, the telematics processing operation 220 may require that the acceleration data 222 extend above the threshold 224 for a certain period of time (e.g., one second, 0.5 seconds, 0.25 seconds). The server 102 and/or the primary device 130 may accordingly compute the duration from time T5 to time T6 prior to identifying an anomalous vehicle operation event 104.

It should be understood that the telematics processing operations 200, 210, 220 discussed above are merely exemplary implementations of the analysis that may be performed by the server 102. One skilled in the art, upon reviewing the present disclosure, may recognize one or more additional telematics processing operations that may be performed by the server 102. The present disclosure contemplates all such telematics processing operations.

Figure 3:
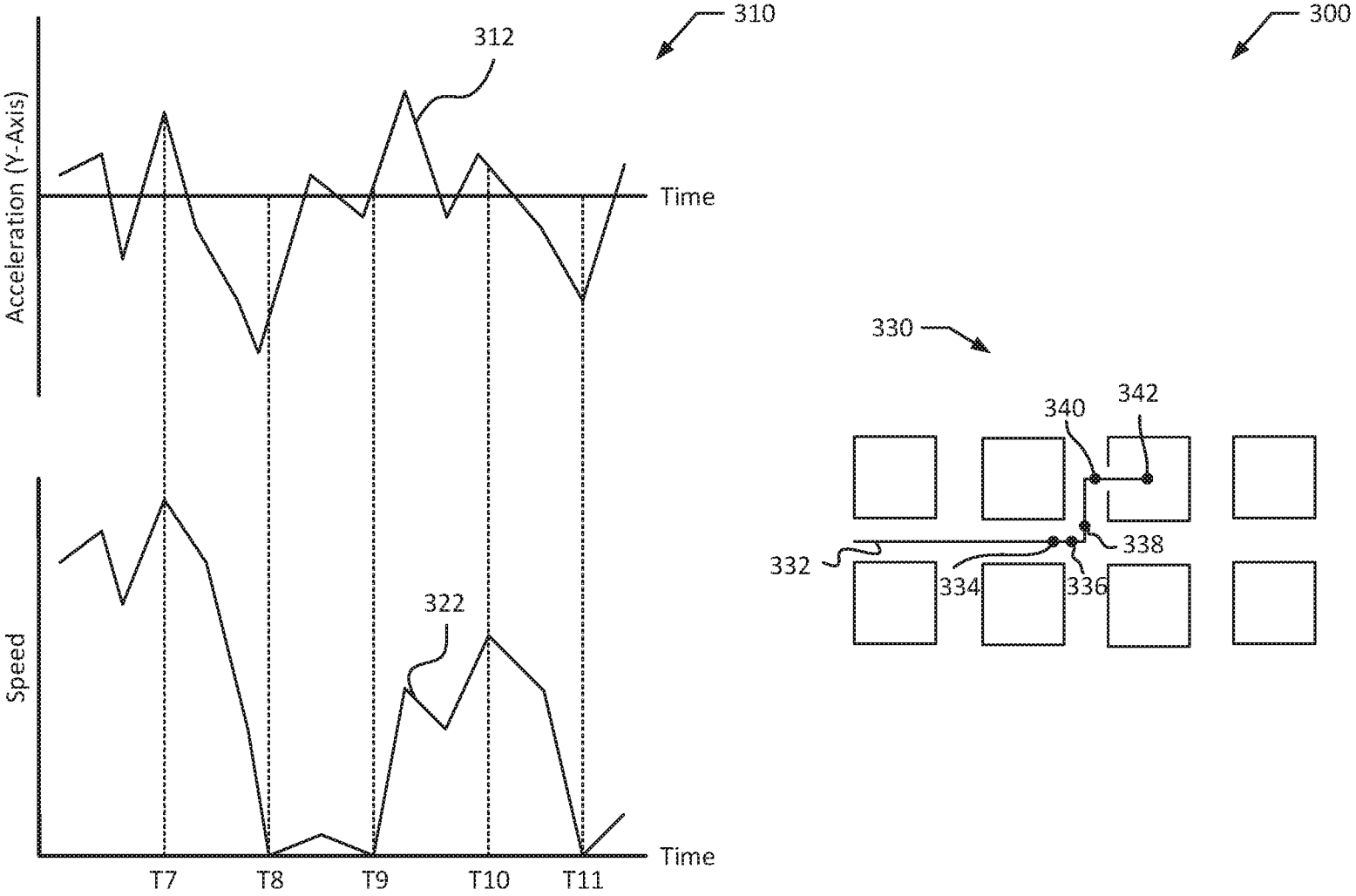
FIG. 3 illustrates an anomalous event processing operation according to an exemplary embodiment of the present disclosure.

In response to detecting an anomalous vehicle operation event, the server 102 may perform anomalous event processing. FIG. 3 depicts an anomalous event processing operation 300 according to an exemplary embodiment of the present disclosure. In particular, the anomalous event processing operation 300 may be performed to compare location information 106 with the telematics information 132 in order to further process the anomalous vehicle operation event 104.

As illustrated, the anomalous event processing operation 300 includes telematics information 310 and location information 330. The telematics information 310 may be received from the primary device 130 and may correspond to a period of time surrounding the detection of an anomalous vehicle operation event 104. In particular, after detecting an anomalous vehicle operation about 104, the server 102 and/or the primary device 130 may extract telematics information for the time before and after the detected anomalous vehicle operation about 104 (e.g., one minute before and after, 30 seconds before and after, 10 seconds before and after, 5 seconds before and after). The telematics information may be extracted in compliance with a user setting (e.g., a user setting permitting access to the telematics information).

As further illustrated, the telematics information 310 includes acceleration data 312 along the y-axis of the vehicle and speed data 322 of the vehicle. The location information 330 depicts a route 332 followed by the vehicle. The route 332 may correspond to the location of the vehicle at least partially during the same period of time as the telematics information 310. For example, location 334 may correspond to the location of the vehicle at time T7, location 336 may correspond with the location of the vehicle at time T8, location 338 may correspond to the location of the vehicle at time T9, location 340 may correspond to the location of the vehicle at time T10, and location 342 may correspond to the location of the vehicle at time T11.

While performing the anomalous event processing operation 300, the server 102 may first determine whether an identified anomalous vehicle operation event 104 is a potential vehicle collision. For example, the server 102 may analyze the telematics data 310 to determine whether a vehicle collision has potentially occurred. As depicted, the speed data 322 indicates a sharp decrease in speed between times T7 and T8, and the acceleration data 312 indicate a corresponding sharp deceleration between times T7 and T8. The server 102 may therefore determine that the anomalous vehicle operation event 104 is a potential vehicle collision. This analysis may be performed at least in part by the model 112, which may be trained to analyze certain types of telematics data 310 in order to identify potential vehicle collisions. After identifying the potential vehicle collision, the server 102 may then determine a location of the potential vehicle collision at least in part based on the location information 330. For example, the server 102 and/or the model 112 may identify a collision indicator between times T7 and T8 based at least in part on the sharp deceleration and/or the rapid decrease in speed between these times. The server 102 and/or the model 112 may correlate the collision indicator with the location information 330. For example, the location 334 corresponds to time T7 and the location 336 corresponds to time T8. The server 102 and/or the model 112 may therefore determine that the potential vehicle collision occurred between these two locations, or at location 334, as that is associated with time T7, when the sharp deceleration begins. For example, if the potential vehicle collision occurred at location 334, the vehicle may have proceeded to the location 336 during the collision (e.g., may have been pushed into the intersection at location 336). After the collision, the vehicle may have proceeded to location 342 (e.g., a parking lot) along the depicted route, for example, so that an operator of the vehicle can assess damage to the vehicle and/or await the arrival of emergency services.

Without access to the telematics information 310, the server 102 may instead have incorrectly determined that the collision occurred at locations 338, 340 closer to the end of the route 332. However, by correlating the location information 330 with the telematics information 310, the model 112 of the server 102 may more accurately determine the location of the collision as the location 334. The server 102 and/or the model 112 may, in certain instances, incorporate additional information, such as road information, corresponding to the locations 334, 336, 338, 340, 342. For example, the road information may indicate that the location 334 is associated with an unprotected left turn which has been the site of one or more previous collisions. Accordingly, the server 102 and/or the model 112 may therefore weight the location 334 as being more likely location of the accident and other locations 340, 342 after the unprotected left turn.

Figure 4:
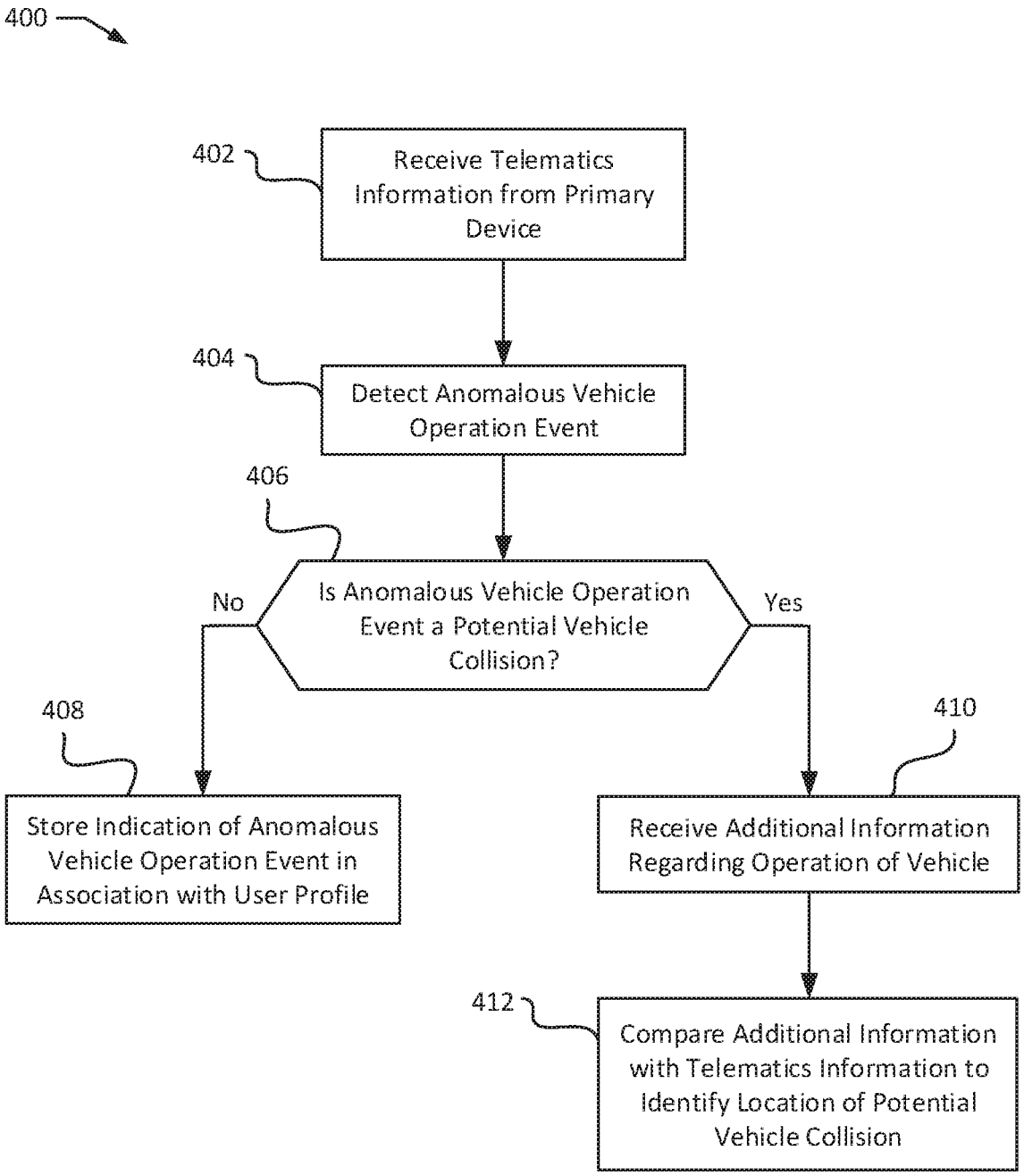
FIG. 4 illustrates a method according to an exemplary embodiment of the present disclosure.

FIG. 4 depicts a method 400 according to an exemplary embodiment of the present disclosure. The method 400 may be performed to receive and process telematics information 132 from a primary device 130 associated with a vehicle. The method 400 may be implemented on a computer system. For example, the method 400 may be implemented by the server 102, the primary device 130, the secondary device 150, and/or the routing information database 120. The method 400 may also be implemented by a set of instructions stored on a computer readable medium that, when executed by a processor, cause the computer system to perform the method 400. For example, all or part of the method 400 may be implemented by the processor 108 and the memory 110. Although the examples below are described with reference to the flowchart illustrated in FIG. 4, many other methods of performing the acts associated with FIG. 4 may be used. For example, the order of some of the blocks may be changed, certain blocks may be combined with other blocks, one or more of the blocks may be repeated, and some of the blocks described may be optional.

The method 400 may begin with the server 102 receiving telematics information 132 from the primary device 130 (block 402). For example, the server 102 may receive the telematics information 132 via a communicative link with the primary device 130 (e.g., a wired or wireless communicative link such as the Internet or other network). In particular, the server 102 may receive the telematics information 132 from the primary device 130 in accordance with a user setting associated with the primary device 130 (e.g., permitting access to the telematics information 132). The telematics information 132 may be received from the primary device at regular intervals (e.g., every 5 minutes, every minute, every 30 seconds). In other implementations, the telematics information may be received based on a current operation of the vehicle. For example, as explained previously, the primary device 130 may be configured to detect anomalous vehicle operation events 104. The server 102 may therefore also receive the telematics information 132 when the primary device 130 detects an anomalous vehicle operation event. In still further implementations, the telematics information 132 may be received upon completion of a trip (e.g., after dropping off a passenger during a rideshare trip). As explained previously, the telematics information 132 may be generated based on sensor data 134, which may be converted to telematics information 132. In particular, the sensor data 134 may be adapted to the frame of reference of the vehicle so that the telematics information 132 represents operation of the vehicle.

Anomalous vehicle operation events 104 may then be detected based on the telematics information 132 (block 404). For example, the server 102 may analyze the received telematics information 132 to detect one or more anomalous vehicle operation events 104. The anomalous vehicle operation events 104 may indicate one or more potentially irregular and/or irrational driving operations, such as hard braking, hard acceleration, fast cornering, fast vehicle speeds, and phone handling during vehicle operation. In certain implementations, the server 102 may detect the anomalous vehicle operation events 104 based on processing operations or heuristics, such as the telematics processing operations 200, 210, 220. In certain implementations, as discussed above, the anomalous vehicle operation events may be detected by the primary device 130. In such instances, block 404 may be performed before block 402. Further, the telematics information 132 may specify the detected anomalous vehicle operation events 104 and may identify relevant portions of the telematics information 132 associated with the anomalous vehicle operation events 104 (e.g., timestamps for the telematics information 132 associated with the anomalous vehicle operation events).

The server 102 may then determine whether the anomalous vehicle operation event 104 is a potential vehicle collision (block 406). For example, the server 102 may analyze certain portions of the received telematics information 132 (e.g., speed and acceleration) to determine whether a potential vehicle collision has occurred. In particular, the server 102 may utilize a model 112 trained to identify potential vehicle collisions based on the received telematics information 132. In other implementations, the server 102 may use one or more heuristics or processing operations, such as the anomalous event processing operation.

In further implementations, in determining whether the anomalous vehicle operation event 104 is a potential vehicle collision, the server 102 may determine an operation type of the anomalous vehicle operation event 104. For example, the server 102 may determine whether the anomalous vehicle operation event 104 is one or more of a hard braking event, a hard cornering event, a hard acceleration event, a speeding event, and/or a phone handling event. In making such a determination, the server 102 may compare the anomalous vehicle operation event 104 to anomalous vehicle operations that occurred previously. For example, the server 102 may compare telematics information 132 associated with the anomalous vehicle operation event 104 to telematics information associated with the anomalous vehicle operations that occurred previously. In performing the comparison, the server 102 may utilize one or more heuristics. For example, the server 102 may perform a nearest neighbor search for one or more of the anomalous vehicle operation events that are most similar to the anomalous vehicle operation event 104 (e.g., most similar in acceleration, speed, location). The server 102 may identify an operation type for the anomalous vehicle operation event 104 based on an operation type of the anomalous vehicle operation events that occurred before the current vehicle operation event 104 and are most similar to the anomalous vehicle operation event 104 (e.g., based on an operation type of the majority of the previous anomalous vehicle operation events that are most similar). In other implementations, the server 102 may additionally or alternatively perform the comparison using one or more predictive models (e.g., a model 112). For example, the model 112 may be trained to compare the anomalous vehicle operation event 104 to previous anomalous vehicle operation events in order to identify an operation type. In certain implementations, the model 112 may identify the most similar, anomalous vehicle operation events that occurred previously, and may select the operation type based on an operation type corresponding to the most similar, previously-occurring anomalous vehicle operation events. After determining the operation type for the anomalous vehicle operation event 104, the server 102 may determine whether the anomalous vehicle operation event 104 as a potential vehicle collision based on the determined operation type.

If the anomalous vehicle operation event is not a potential vehicle collision, the server 102 may store an indication of the anomalous vehicle operation event 104 and association with the user profile (block 408). For example, the server 102 may store the indication in association with the user profile associated with an operator of the vehicle. The user profile may, in certain instances, be determined by the routing information database 120. For example, the route 124A-B may indicate an operator of the vehicle 126A-B for which the telematics information 132 is received (e.g., an operator of a car, a rider operating a scooter or bicycle). Based on such information, the server 102 may identify the user profile associated with the vehicle operator and may store the indication of the anomalous vehicle operation event in association with the user profile. The indication may include identifiers of one or more of (i) an operation type of the anomalous vehicle operation event 104, (ii) a location of the anomalous vehicle operation event 104, (iii) a time of the anomalous vehicle operation event 104, (iv) other individuals within or near the vehicle during the anomalous vehicle operation event 104, and (v) a route 124A-B associated with the anomalous vehicle operation event 104 or associated with the vehicle at the time of the anomalous vehicle operation event 104. The indication of the anomalous vehicle operation event 104 may be stored in accordance with one or more user settings (e.g., user settings associated with user profiles corresponding to the primary device 130 and/or the secondary device 150). For example, the user settings may specify a predetermined period of time (e.g., a day, a week, a month) for which the information can be stored. After the predetermined period of time has passed, the information may be deleted from the routing information database 120 in compliance with the user settings.

In certain implementations, an alert regarding the anomalous vehicle operation event 104 may be generated for presentation to the user device. The alert may include all or part of the information stored by the indication of the anomalous vehicle operation event 104. In certain implementations, the alert may be presented to the user device via a software application, such as an application provided by a TNC. The alert may be presented at or near the time of detecting the anomalous vehicle operation event 104. In other implementations, the alert may be presented at a later time (e.g., after completion of a route 124A-B associated with the anomalous vehicle operation event 104. In still further implementations, a single alert may be generated for multiple anomalous vehicle operation events 104. For example, during a day of operating a vehicle, more than one anomalous vehicle operation event 104 may be identified. At the end of the day, or while taking a break, a summary alert may be presented to the user device that summarizes the identified anomalous vehicle operation events 104. In this way, the system 100 may avoid generating distracting and/or excessive alerts, while still ensuring awareness of anomalous vehicle operation events 104.

If, however, the anomalous vehicle operation event 104 is a potential vehicle collision, the server 102 may receive additional information regarding operation of the vehicle (block 410). As explained above, the server 102 may, in certain implementations, retrieve location information 106 and the routing information database associated with operation of the vehicle. The location information 106 may include routing information for the vehicle reflecting previous and/or intended future locations of the vehicle. Additionally or alternatively, the location information 106 may include street information regarding streets near the potential vehicle collision. In still further implementations, the additional information may also include telematics information 152 from the secondary device 150.

The server 102 may then compare the received additional information with the telematics information 132 to identify a location of the potential vehicle collision (block 412). For example, where the additional information includes location information 106, the server 102 may compare the location information 106 with the telematics information 132 to identify the location of the potential vehicle collision. In certain implementations, this comparison may be performed by the server 102 according to one or more heuristics. For example, the server 102 may identify a time of the potential vehicle collision based on the telematics information 132 and may identify a location of the potential vehicle collision based on the identified time and the location information 106 (e.g., routing information). In particular, the location of the potential vehicle collision may be determined according to the anomalous event processing operation 300. In other implementations, the comparison may be performed at least in part by a predictive model, such as the model 112. For example, the model 112 may be configured to analyze both the telematics information 132 and the location information 106 together to determine a location of the potential vehicle collision. In implementations where the additional information includes telematics information 152 from a secondary device 150, the telematics information 152 may be used to validate the telematics information 132, as explained further below.

Although not depicted, the server 102 may also store an indication of the anomalous vehicle operation event 104 in association with a user profile of a vehicle operator, as discussed above in connection with block 408. For example, the server 102 may store an indication of the anomalous vehicle operation event 104 after identifying the location of the potential vehicle collision at block 412. As explained above, the indication of the anomalous vehicle operation event 104 may be stored for a predetermined period of time (e.g., a day, a week, a month) in compliance with a user setting of, e.g., the primary device 130 and/or the secondary device 150.

Additionally or alternatively, after any of blocks 406, 410, 412, the server 102 may assist with reporting or otherwise recording the details of the potential vehicle collision. For example, the server 102 may prepare reporting documentation including information regarding the potential vehicle collision. For example, after identifying the location of the potential vehicle collision at block 412, the server 102 may generate reporting documentation that includes the identified location of the potential vehicle collision. The reporting documentation may then be presented to one or both of the primary device 130 and the secondary device 150 for further processing. In particular, the reporting documentation may include requests for additional information, such as details or other information from users associated with the primary device 130 and/or the secondary device 150 regarding the potential vehicle collision (e.g., accident accounts). The reporting documentation may also request additional information regarding the potential vehicle collision including, e.g., pictures of the vehicle(s) involved in the potential vehicle collision, information regarding one or more individuals involved in the potential vehicle collision. The reporting documentation may than be utilized in connection with preparing an insurance claim resulting from the potential vehicle collision and/or in otherwise reporting the potential vehicle collision. For example, the server 102 may further process the information received in the reporting documentation to prepare and process an insurance claim for one or more individuals and/or vehicles involved in the potential vehicle collision.

Figure 5B:
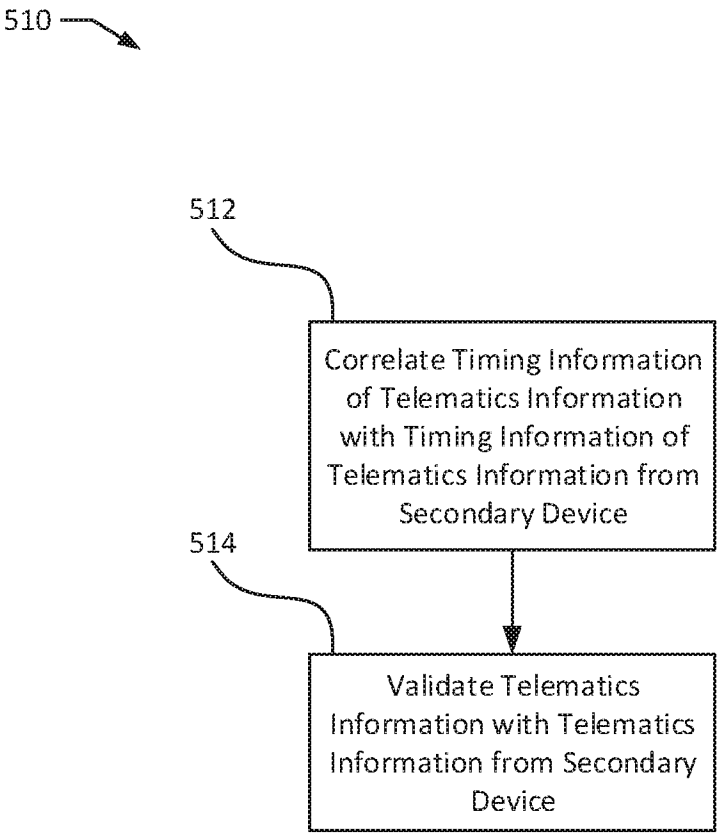
FIGS. 5A-5B illustrate methods according to exemplary embodiment of the present disclosure.
Figure 5A:
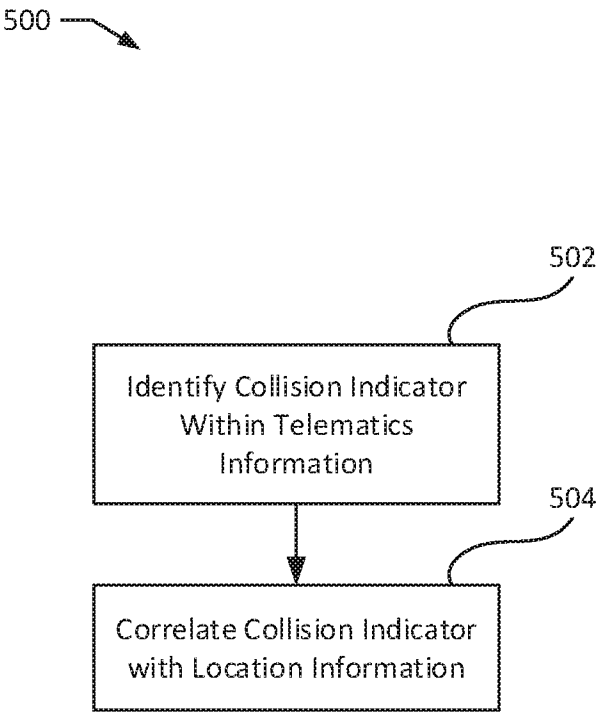

FIGS. 5A and 5B depict methods 500, 510 according to an exemplary embodiment of the present disclosure. The methods 500, 510 may be performed to receive and process telematics information 132 from a primary device 130 associated with a vehicle. The methods 500, 510 may be implemented on a computer system, such as the system 100. For example, the methods 500, 510 may be implemented by the server 102, the primary device 130, the secondary device 150, and/or the routing information database 120. The methods 500, 510 may also be implemented by a set of instructions stored on a computer readable medium that, when executed by a processor, cause the computer system to perform the methods 500, 510. For example, all or part of the methods 500, 510 may be implemented by the processor 108 and the memory 110. Although the examples below are described with reference to the flowchart illustrated in FIGS. 5A and 5B, many other methods of performing the acts associated with FIGS. 5A and 5B may be used. For example, the order of some of the blocks may be changed, certain blocks may be combined with other blocks, one or more of the blocks may be repeated, and some of the blocks described may be optional.

The method 500 may be performed to compare additional information with the telematics information 132 to identify a location of a potential vehicle collision. For example, the server 102 may perform the method 500 in connection with block 412. The method 500 begins with identifying a collision identifier within the telematics information 132 (block 502). The collision indicator may be identified as one or types of features within the telematics information 132 indicative of the time of a vehicle collision. For example, the server 102 may identify a collision indicator based on certain types of telematics information regarding operation of the vehicle. In particular, and as discussed above in connection with the anomalous event processing operation 300, the server 102 may analyze at least Y-axis acceleration data 312 and speed data 322 of the vehicle and may identify a collision indicator when one or both of the Y-axis acceleration data 312 and the speed data 322 include a sharp decrease.

The collision indicator may then be correlated with the location information 106 (block 504). The collision indicator and the location information 106 may be correlated so that a location of the possible vehicle collision can be determined based on the location information 106. In certain implementations, the collision indicator and the location information 106 may be correlated based on timing information of the telematics information 132 and the location information 106. In particular, the server 102 may identify a timestamp associated with the collision indicator and may correlate the collision indicator with the location information 106 by identifying a location of the vehicle from the location information 106 at the same time (e.g., with the same or similar timestamp) as the collision indicator. In additional or alternative implementations, the collision indicator and the location information 106 may be correlated based on speed or other indicators from the telematics information 132. For example, the server 102 may determine a speed of the vehicle based on changes in location within the location information 106 over time. The server 102 may then match the speed of the vehicle as determined based on the location information 106 with a speed of the vehicle as indicated within the telematics information 132. In such implementations, the collision indicator may be correlated with the location information 106 by identifying the location from within the location information 106 that corresponds to the collision indicator within the speed data of the telematics information 132. Once correlated, with the collision indicator, the location information 106 may be used to determine a location of the potential vehicle collision, e.g., at block 412.

The method 510 may be performed to validate the telematics information 132 received from the primary device 130 based on telematics information 152 received from the secondary device 150. For example, the server 102 may perform the method 510 prior to determining whether the anomalous vehicle operation event 104 is a potential vehicle collision at block 406. As another example, the server 102 may perform the method 510 prior to comparing the additional information with the telematics information 132 at block 412. The method 510 may begin with correlating timing information of the telematics information 132 with timing information of the telematics information 152 from the secondary device 150 (block 512). In certain implementations, the server 102 may correlate the telematics information 152 from the secondary device 150 based on common timestamps with the telematics information 132 (e.g., timestamps for overlapping periods of time). In other implementations, the server 102 may correlate the telematics information 152 with the telematics information 132 based on common features. For example, the server 102 may identify increases or decreases in acceleration data indicated by the telematics information 152 with corresponding increases or decreases in acceleration from the telematics information 132.

The server 102 may then validate the telematics information 132 with the telematics data 152 from the secondary device 150 (block 514). For example, the server 102 may compare the telematics information 132 with that of the telematics information 152 to determine whether the anomalous vehicle operation event 104 is indicated in both the telematics information 132 and the telematics information 152. For example, the server 102 may determine whether certain telematics features that gave rise to identifying the anomalous vehicle operation of 104 are also present within the telematics information 152 (e.g., increases or decreases in acceleration, deceleration, speed).

By verifying the telematics information 132 using the telematics information 152 from a secondary device 150, the server 102 may be able to account for situations where the sensors of the primary device 130 are inaccurate and incorrectly detect anomalous vehicle operation events 104. Therefore, by incorporating telematics information 132, 152 from two separate devices 130, 150, the server 102 may be able to account for sensor issues and inaccuracies and may thereby increase the overall accuracy of telematics processing. Further, because, in certain implementations, both the primary device 130 and a secondary device 150 may be implemented by mobile devices, this improved telematics accuracy may be achievable without requiring specialized hardware to be installed in the vehicle.

Alternative techniques for validating the telematics information 132 based on telematics information 152 of a secondary device 150 are also possible. For example, the server 102 may verify the telematics information 132 based on the telematics information 152 by analyzing the telematics information 152 for anomalous vehicle operation events 104. This analysis may use techniques similar to those discussed above in connection with analyzing the telematics information 132. In performing this analysis, if the server 102 determines that the same anomalous vehicle operation event 104 is present within both the telematics information 132 from the primary device 130 and the telematics information 152 from the secondary device 150, the server 102 may determine that the anomalous vehicle operation event 104 is verified and is likely to have actually occurred.

All or part of the methods 500, 510 may be performed at least in part by a predictive model. For example, all or part of the methods 500, 510 may be performed at the model 112 of the server 102. In certain implementations, the methods 500, 510 may be implemented by separate models 112. In other implementations, the methods 500, 510 may be implemented by the same model 112. The models 112 implementing the methods 500, 510 may be trained to perform the above analysis, e.g., based on data sets of previously-occurring events. For example, a model 112 implementing the method 500 may be trained on a data set of vehicle collisions that occurred previously (e.g., confirmed vehicle collisions). In another example, a model 112 implementing the method 510 may be trained in a data set of anomalous vehicle operation events 104 that occurred previously, associated telematics information from a primary device, and/or associated telematics information from a secondary device (e.g., to confirm proper correlation between the telematics information 132 and the telematics information 152 and accurate verification of occurrences of anomalous vehicle operation events 104).

Figure 6:
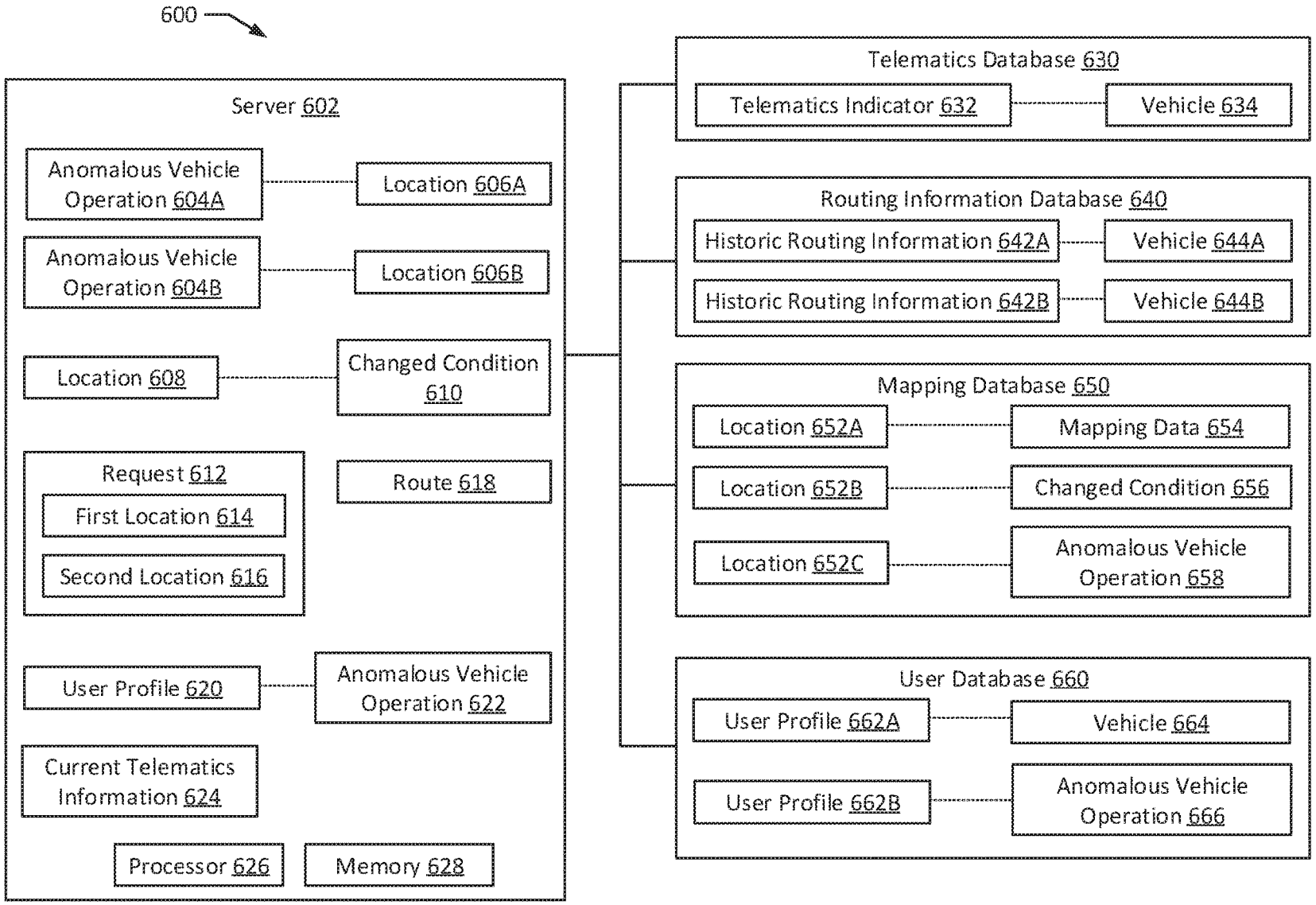
FIG. 6 illustrates a system according to an exemplary embodiment of the present disclosure.

FIG. 6 depicts a system 600 according to an exemplary embodiment of the present disclosure. The system 600 may be configured to process previously-stored telematics indicators, such as telematics information 132, 152, received over a period of time. In particular, the system 600 may process previously-stored telematics indicators in order to enable prospective use of the telematics indicators to help avoid or reduce the occurrence of anomalous vehicle operations in the future. For example, the system 600 may utilize previously-stored telematics indicators in order to generate routes that avoid locations with frequent anomalous vehicle operation events. The system 600 may also utilize previously stored telematics indicators to personalize routes for users and to account for certain types of anomalous vehicle operation events frequently associated with the users.

As illustrated, the system 600 includes a server 602, a telematics database 630, a routing information database 640, a mapping database 650, and a user database 660. The telematics database 630 may be configured to store telematics indicators 632 in association with vehicle 634. The telematics indicators 632 may indicate vehicle operations for the corresponding vehicle 634. For example, the telematics indicator 632 may indicate vehicle operations on previously-completed or in-progress driving events for the vehicle 634. The telematics indicators 632 may include information similar to the telematics information 132, 152 received from the primary database 130. In certain implementations, the vehicle 634 associated with the telematics indicators 632 may be determined based on route data. For example, the vehicle 634 may be operated in connection with a TNC and may complete one or more trips transporting users of the TNC. The vehicle 634 may then be determined based on corresponding information received from the TNC (e.g., in connection with completed transportation trips on the TNC).

The routing information database 640 may store historic routing information 642A-B in association with one or more vehicles 644A-B. The historic routing information 642A-B may indicate routes traveled by the associated vehicles 644A-B (e.g., during completion of one or more transportation trips). Similar to the telematics database 630, the vehicle 644A-B corresponding to the historic routing information 642A-B may be determined based on completed transportation events for a TNC. In particular, the historic routing information 642A-B may indicate routes traveled by the vehicles 644A-B in completing the trips.

The mapping database 650 may store locations 652A-C in association with further information. The locations 652A-C may indicate one or more physical locations (e.g., locations along which transportation routes may exist). For example, the locations 652A-C may correspond to one or more locations on roads, such as a starting location or pickup location on the road and/or an ending location or destination location on the road. The mapping database 650 may store mapping data 654 in association with the locations 652A-C. The mapping data 654 may indicate one or more navigational and/or transportation restrictions for vehicles operating in the locations 652A-C. For example, the mapping data 654 may indicate the direction of travel at the location 652A, turn restrictions or speed limits at the location 652A, points of interest at the location 652A-A, and/or traffic information at the location 652A. Other types of mapping data 654 may also be readily apparent to one skilled in the art in light of the present disclosure and such mapping data 654 is contemplated by the present disclosure.

In some instances, the mapping database 650 may also store changed conditions 656 in connection with the locations 652B. The changed conditions 656 may indicate one or more road conditions or other aspects of the location 652B that have changed recently (e.g., within a predetermined period of time, or since a preceding update of the mapping database 650). For example, the changed conditions 656 may represent one or more of changed traffic conditions or changed road conditions at the location 652B. The mapping database 650 may also store anomalous vehicle operations 658 in association with locations 652C. The anomalous vehicle operations 658 may represent irregular, irrational, or otherwise undesirable vehicle operation patterns occurring at the associated locations 652C. For example, the anomalous vehicle operations 658 may include one or more of a braking event, an acceleration event, a cornering event, a speeding event, and a phone handling during vehicle operation event.

The server 602 may be configured to receive telematics indicators 632 from the telematics database 630 and identify anomalous vehicle operations 604A-B based on the telematics indicators 632. In particular, the server 602 may receive telematics indicators 632 in compliance with one or more user settings associated with the telematics indicators 632 (e.g., allowing access to the telematics indicators 632). For example, the server 602 may identify anomalous vehicle operations 604A-B based on the telematics indicators 632 using heuristics and/or processing operations similar to those discussed above in connection with the telematics processing operations 200, 210, 220. In particular, the server 602 may be configured to utilize one or more heuristics or predictive models to identify the anomalous vehicle operations 604A-B. The server 602 may also identify locations 606A-B associated with the identified anomalous vehicle operations 604A-B. For example, the server 602 may identify the locations 606A-B based on historic routing information 642A-B stored in the routing database 640. In particular, the server 602 may identify historic routing information 642A-B associated with the same vehicle 644A-B as the received telematics indicators 632. The server 602 may then correlate the telematics indicators 632 with the corresponding historic routing information 642A-B to identify the location 606A of the corresponding vehicle 634, 644A-B at the time of the anomalous vehicle operation 604A-B.

The server 602 may also be configured to identify one or more changed conditions 610 associated with locations 608. For example, the server 602 may analyze anomalous vehicle operations 658 stored in association with a particular location 608 within the mapping database 650. Upon detecting a change to the associated anomalous vehicle operation 658 (e.g., a difference in frequency or type of anomalous vehicle operation 658), the server 602 may identify a changed condition 610 associated with the location 608. As discussed further below, depending on the changes to the associated anomalous vehicle operation 658, the changed conditions 610 may indicate one or more of a changed road condition (e.g., construction condition, open lane condition, safety condition) of the location 608 and/or a changed traffic condition (e.g., more traffic or less traffic) at the location 608.

The server 602 may further be configured to receive requests 612 for generating a route 618 between the first location 614 and a second location 616. For example, the requests 612 may be received in connection with the filling transportation requests (e.g., performing route requests) for a TNC. The server 602 may generate the route 618 in response to received requests 612. In certain implementations, the route 618 may be generated based on anomalous vehicle operations 658 stored in association with locations 652C between the first location 614 and the second location 616. For example, locations between the first location 614 and the second location 616 may be analyzed for one or more corresponding anomalous vehicle operations 658. Depending on the number and type of associated anomalous vehicle operation(s) 658 and the mapping database 650, one or more of the locations between the first location 614 and the second location 616 may be identified as a hazardous or otherwise undesirable location. Accordingly, the server 602 may generate the route 618 to avoid the undesirable locations.

In still further implementations, the server 602 may be configured to identify one or more user profiles 620 associated with anomalous vehicle operations 622 that have been detected based on received telematics indicators 632. For example, the received telematics indicators 632 may include user information identifying vehicle operators associated with the vehicle 634 that corresponds to the received telematics indicators 632. The server 602 may identify user profiles in compliance with user settings (e.g., user settings associated with the user profiles 620) that indicate the user profiles 620 are permitted to be identified based on associated anomalous vehicle operations 622.

In certain implementations, the user database 660 may also store indications of vehicles 664 associated with certain user profiles 662A. In such implementations, the server 602 may identify the user profile 620 associated with the identified anomalous vehicle operation 622 by locating the user profile within the user database 660 associated with a vehicle that corresponds to the received telematics indicators 632 in the telematics database 630. In certain implementations, the server 602 may generate the route 618 based on anomalous vehicle operations 666 stored in association with user profiles 662B in the user database 660. For example, the server 602 may analyze anomalous vehicle operations 666 stored in association with the user profile 662B of a user operating a vehicle along the route 618 (e.g., servicing the request 612). The server 602 may identify certain types of anomalous vehicle operations that are frequently associated with the user profile 662B and may generate the route 618 to avoid locations associated with the anomalous vehicle operations that are frequently associated with the user profile 662B. In still further implementations, the server 602 may receive current telematics information 624 reflecting operation of a vehicle associated with a certain user profile. The server 602 may compare the current telematics information 624 with historical telematics information associated with the user profile. For example, although not depicted, the user database 660 may store telematics indicators in connection with user profiles 662A-B in addition to the anomalous vehicle operations 666. The server 602 may therefore identify such telematics indicators and/or anomalous vehicle operations 666 associated with the user profile that is associated with the current telematics information 624. As explained further below, based on the comparison, the server 602 may determine whether a user associated with the user profile is actually operating the vehicle. This determination may be performed in connection with one or more user settings associated with the user profile permitting such analysis.

The information stored by the telematics database 630, the routing information database 640, the mapping database 650, and the user database 660 may be stored in accordance with one or more user settings. For example, the user settings may specify a predetermined period of time (e.g., a day, a week, a month) for which the information can be stored. After the predetermined period of time has passed, the information may be deleted from the telematics database 630, the routing information database 640, the mapping database 650, and the user database 660 in compliance with the user settings.

One or more of the server 602, the telematics database 630, the routing information database 640, the mapping database 650, and the user database 660 may be implemented by a computer system. For example, the processor 626 and the memory 628 may implement one or more operational features of the server 602. In particular, the memory 628 may store instructions which, when executed by the processor 626, cause the processor to perform one or more of the operational features of the server 602. Additionally, although not depicted, one or more of the telematics database 630, the routing information database 640, the mapping database 650, and the user database 660 may contain one or both of a processor and a memory similarly configured to implement one or more respective operational features.

In certain implementations, two or more of the database 630, 640, 650, 660 may be implemented by a single database. For example, the telematics database 630 and the routing information database 640 may be implemented by a single database (e.g., by storing historic routing information 642A-B and telematics indicators 632 in association with vehicles 634, 644A-B in a single database). In still further implementations, all of the databases 630, 640, 650, 660 may be implemented by a single database or other type of single storage (e.g., each of the databases 630, 640, 650, 660 may be implemented as one or more tables within the same database).

Figure 7:
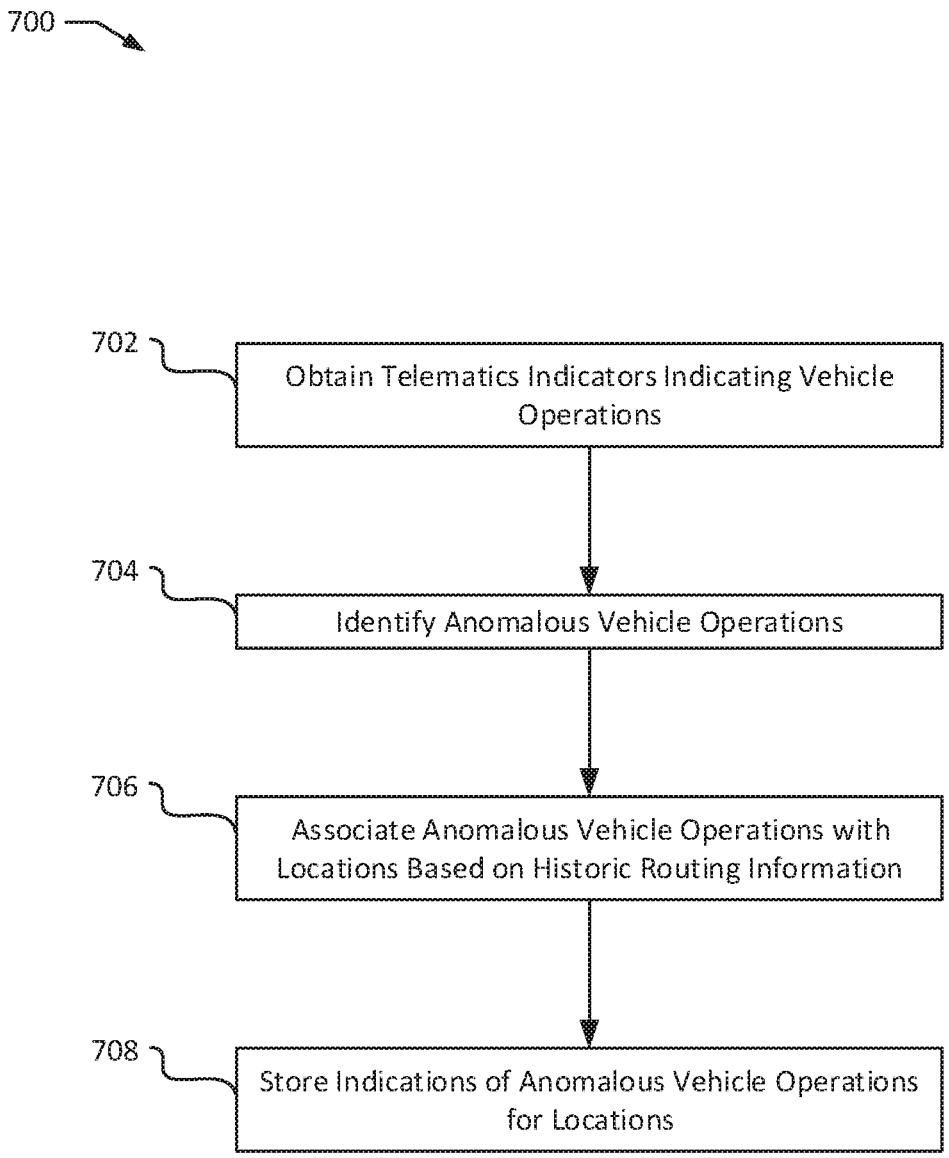
FIG. 7 illustrates a method according to an exemplary embodiment of the present disclosure.

FIG. 7 depicts a method 700 according to an exemplary embodiment of the present disclosure. The method 700 may be performed to receive and process telematics indicators 632 in order to detect and determine respective locations 606A-B that may identify or otherwise illustrate where anomalous vehicle operation(s) 604A-B occurred, as indicated by the telematics indicators 632. The method 700 may be implemented on a computer system, such as the system 600. For example, the method 700 may be implemented by the server 602, the telematics database 630, routing information database 640, the mapping database 650, and the user database 660. The method 700 may also be implemented by a set of instructions stored on a computer readable medium that, when executed by a processor, cause the computer system to perform the method 700. For example, all or part of the method 700 may be implemented by the processor 626 and the memory 628. Although the examples below are described with reference to the flowchart illustrated in FIG. 7, many other methods of performing the acts associated with FIG. 7 may be used. For example, the order of some of the blocks may be changed, certain blocks may be combined with other blocks, one or more of the blocks may be repeated, and some of the blocks described may be optional.

The method 700 may begin with obtaining telematics indicators 632 indicating operations of the vehicle 634 (block 702). Referring to FIG. 6, the telematics indicators 632 may be obtained by a server 602 from a telematics database 630. In particular, the telematics indicators 632 may be received in compliance with one or more user setting (e.g., user settings allowing or prohibiting access to the telematics indicators 632). In one specific example, the telematics indicators 632 may be obtained for previously-completed operations of a vehicle 634. In certain implementations, the telematics indicators 632 may be obtained after the completion of each operation of a vehicle 634 (e.g., the completion of each route in connection with a TNC). In other implementations, telematics indicators 632 may be obtained at regular intervals (e.g., every hour, every day, every week, every month, and the like).

Referring again to FIG. 7, the server 602 may identify anomalous vehicle operations 604A-B based on the telematics indicators 632 (block 704). The server 602 may identify the anomalous vehicle operations 604A-B using one or more heuristics and/or predictive models, as discussed above. In certain implementations, the server 602 may identify the anomalous vehicle operation 604A-B according to techniques similar to those discussed above in connection with telematics processing operations 200, 210, 220. The identified anomalous vehicle operation 604A-B may indicate a specific type and/or severity level of the anomalous vehicle operation 604A-B. For example, where the anomalous vehicle operation 604A is identified as a hard braking event, the anomalous vehicle operation 604A may store an indication of a hard braking event. Additionally, the anomalous vehicle operation 604A may story a severity level of the anomalous vehicle operation (e.g., excessive, severe, or extreme). In certain implementations, the severity level may be determined according to one or more predetermined thresholds. Indications of anomalous vehicle operations 604A-B and/or the severity level may be stored in accordance with a user setting specifying a predetermined period of time (e.g., a day, a week, a month) for which the information can be stored. After the predetermined period of time has passed, the information may be deleted.

The server 602 may associate the anomalous vehicle operations 604A-B with locations 606A-B based on historic routing information 642A-B (block 706). The server 602 may identify corresponding historic routing information 642A-B from the routing information database 640 that corresponds to the same vehicle as the received telematics indicators 632. Accordingly, for each anomalous vehicle operation 604A-B that is identified, the server 602 may identify a corresponding vehicle. The vehicle that corresponds to an anomalous vehicle operation 604A-B may be identified as the vehicle 634 associated with the telematics indicator 632 from which the anomalous vehicle operation 604A-B was identified. The server 602 may then identify historic routing information 642A-B within the routing information database 640 that corresponds to the identified vehicle.

For example, the anomalous vehicle operation 604A may correspond to the same vehicle 644A as the historic routing information 642A. The server 602 may then analyze the corresponding historic routing information 642A-B to identify the corresponding location 606A-B. Continuing the previous example, the server 602 may analyze the historic routing information 642A-B to identify the location 606A of the anomalous vehicle operation 604A. This analysis may be performed by correlating the telematics indicator 632 that corresponds to the anomalous vehicle operation 604A-B with the corresponding historic routing information 642A-B. For example, the historic routing information 642A-B may be analyzed using techniques similar to the techniques discussed above in connection with the anomalous event processing operation 300. In particular, the server 602 may identify corresponding timing information of the anomalous vehicle operation 604A-B within the telematics indicator 632 (e.g., one or more timestamps corresponding to the anomalous vehicle operation 604A-B). The location 606A-B may then be determined as the location of the vehicle 644A-B indicated by the historic routing information 642A-B at the same time as the anomalous vehicle operation 604A-B (e.g., at the same or similar timestamp). Such an analysis may then be repeated for each anomalous vehicle operation 604A-B identified within the telematics indicators 632 received from the telematics database 630.

Referring again to FIG. 7, the server 602 may store indications of the identified anomalous vehicle operation 604A-B for the determined location 606A-B (block 708). The server 602 may store the indications in a mapping database 650. For example, the server 602 may store the anomalous vehicle operations 604A-B in association with corresponding location 606A-B in a manner similar to that depicted for the location 652C and the anomalous vehicle operation 658 within the mapping database 650. Indications of the identified anomalous vehicle operation 604A-B may be stored in accordance with a user setting specifying a predetermined period of time (e.g., a day, a week, a month) for which the information can be stored. After the predetermined period of time has passed, the indications may be deleted.

In certain implementations, the method 700 may be performed for individual vehicle operations, resulting in telematics indicators 632 being received by the system for individual vehicles 634. For example, as explained above, telematics indicators 632 may be received at the completion of each operation by a vehicle 634. In such instances, the telematics indicator 632 for a given operation may be received and processed independently. In other implementations, the method 700 may be performed for multiple vehicle operations that result in a collection of telematics indicators 632 being received by the system. In such a scenario, the method 700 may be performed on a collection of telematics indicators 632 that correspond multiple vehicle operations performed by the same vehicle 634 (e.g., telematics indicators 632 received on a per-vehicle basis at regular intervals). In yet other examples, the collection of telematics indicators 632 may correspond to multiple vehicle operations that correspond to more than one vehicle 634. In such examples, use and analysis of the collection of telematics indicators 632 may be performed in compliance with user settings associated with each of vehicle that corresponds to the telematics indicators 632.

Figure 8B:
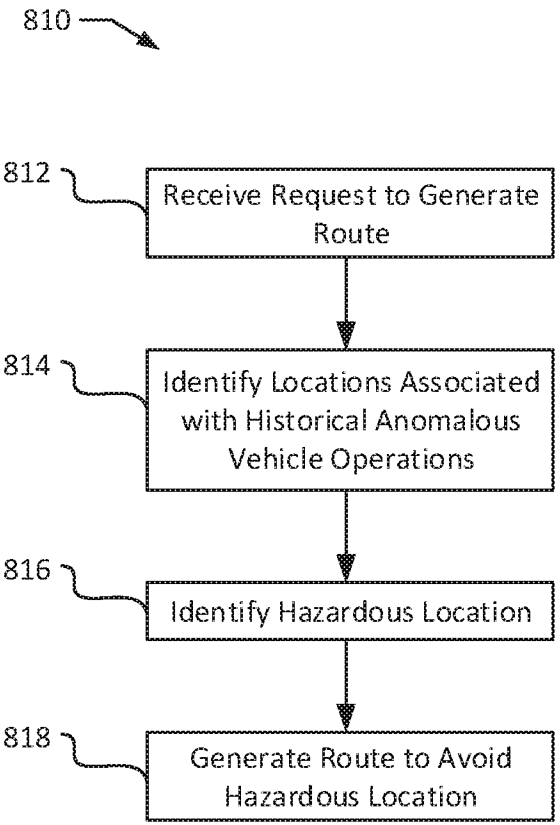
FIGS. 8A-8B illustrate methods according to exemplary embodiments of the present disclosure.
Figure 8A:
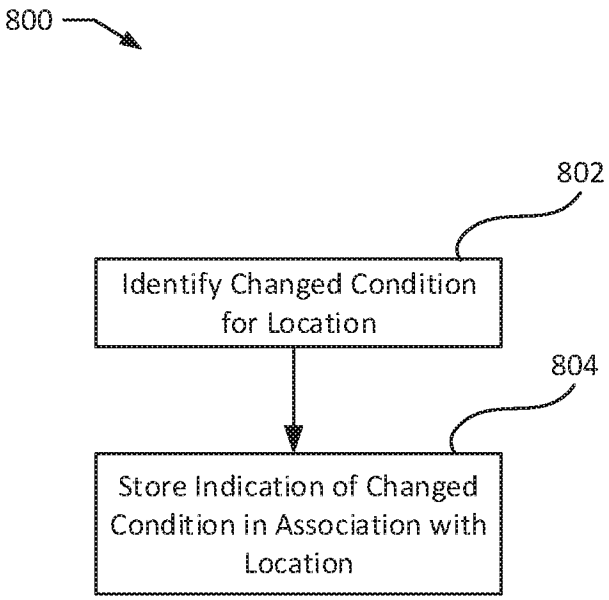

FIGS. 8A-8B depict methods 800, 810 according to an exemplary embodiment of the present disclosure. The methods 800, 810 may be implemented on a computer system, such as the system 600. For example, the methods 800, 810 may be implemented by the server 602, the telematics database 630, routing information database 640, the mapping database 650, and the user database 660. The methods 800, 810 may also be implemented by a set of instructions stored on a computer readable medium that, when executed by a processor, cause the computer system to perform the method. For example, all or part of the methods 800, 810 may be implemented by the processor 626 and the memory 628. Although the examples below are described with reference to the flowchart illustrated in FIGS. 8A-8B, many other methods of performing the acts associated with FIGS. 8A-8B may be used. For example, the order of some of the blocks may be changed, certain blocks may be combined with other blocks, one or more of the blocks may be repeated, and some of the blocks described may be optional.

The method 800 may be performed to determine whether route and/or road conditions changed at one or more locations 608 and to update the mapping database 650 based on any determined changes. In certain implementations, the method 800 may be performed at least in part in conjunction with the method 700. For example, the method 800 may be performed after storing indications of the anomalous vehicle operations 604A-B at block 708.

Referring specifically to FIG. 8, the method 800 may begin with identifying a changed condition 610 associated with the location 608 (block 802). Referring to FIG. 6, the changed condition 610 may be identified by comparing newly-stored anomalous vehicle operations 604A-B at or near the location 608 with previously-stored anomalous vehicle operations 604A-B at or near the location 608. For example, the server 602 may be configured to analyze changes to the anomalous vehicle operations 604A-B, 658 stored in association with locations 652C in the mapping database 650 over time. If the stored anomalous vehicle operations 658 change over time (e.g., change in frequency of occurrence and/or change in type), a changed condition 610 may be identified. For example, the location 608 may historically only have infrequent anomalous vehicle operations. However, the frequency of anomalous vehicle operations stored in association with the location within the mapping database 650 may have increased recently (e.g., in the preceding several hours, several days, one week). In particular, hard braking events may have recently occurred more frequently by vehicles at or near the location 608. Based on the change in anomalous vehicle operations, the server 602 may identify a changed condition 610 association with the location 608. In certain implementations, the server 602 may identify a type of changed condition 610. For example, based on the change in anomalous vehicle operations, the server 602 may determine a type of changed condition 610. Continuing the previous example, the server 602 may determine a change in road condition at the location 608 based on the increase in hard braking events (e.g., road construction, constricted travel lanes, increased pedestrian for traffic). In certain implementations, similar techniques may be used to determine a change in traffic condition at the location 608. For example, changes to anomalous vehicle operations at the location 608 may be analyzed over shorter periods of time in order to detect changes in traffic conditions. In particular, increased occurrences of hard braking events and/or hard acceleration event at the location 608 may indicate an increase in vehicle traffic at the location 608. Detecting such changes to traffic conditions at locations 608 may enable quicker determination of current traffic conditions, as anomalous vehicle operations 604A-B may serve as a leading indicator to increases in traffic congestion.

The server 602 may then store an indication of the changed condition 610 associated with the location 608 (block 804). The server 602 may store the indication in the mapping database 650. For example, the server 602 may store an indication of the changed condition 610 in association with the location 608 in a manner similar to that depicted for the changed condition 656 stored in association with the location 652B within the mapping database 650. The indication of the of the changed condition 610 may be stored in accordance with a user setting specifying a predetermined period of time (e.g., a day, a week, a month) for which the information can be stored. After the predetermined period of time has passed, the indication may be deleted.

The method 810 may be performed to generate routes 618 based at least in part on identified anomalous vehicle operations 604A-B. For example, the method 810 may be performed to generate a route 618 that avoids irrational or undesirable locations. In certain implementations, the method 810 may be performed in connection with the method 700. For example, the method 810 may be performed after storing indications of the anomalous vehicle operations 604A-B at block 708 (e.g., after storing the indications of the anomalous vehicle operations 604A-B in compliance with user settings associated with the anomalous vehicle operations 604A-B). In other implementations, the method 810 may be performed independently of the method 700.

The method 810 may begin with the server 602 receiving a request 612 to generate a route 618 (block 812). The request 612 may specify a first location 614 and a second location 616 and may request generation of a route between the first location 614 and the second location 616 (e.g., in connection with a request for transportation from the first location 614 to the second location 616 from a TNC).

The server 602 may then identify locations associated with historical anomalous vehicle operations (block 814). For example, the server 602 may identify locations between the first location 614 and the second location 616 associated with historical anomalous vehicle operations. Locations between the first location 614 and the second location 616 may include any location along which a route 618 may be generated connecting the first location 614 to the second location 616. In certain implementations, locations between the first location 614 and the second location 616 may be limited to locations within a certain distance of one or both of the first location 614 and the second location 616. In certain implementations, the server 602 may query the mapping database 650 for anomalous vehicle operations 658 associated with locations 652C between the first location 614 and the second location 616.

The server 602 may then identify one or more hazardous locations (block 816). The server 602 may identify hazardous locations between the first location 614 and the second location 616 based on the anomalous vehicle operations 658 returned by the mapping database 650 in response to the query from the server 602. For example, the server 602 may analyze the received anomalous vehicle operation 658 for one or more anomalous vehicle operation 658 associated with the same or similar location 652C. Hazardous locations may be identified as locations associated with at least a certain number of anomalous vehicle operations 658 in the mapping database 650 (e.g., a certain number in a predetermined period of time). For example, the hazardous locations may be identified as locations between the first location 614 and the second location 616 associated with 10 or more anomalous vehicle operations in, e.g., the last day, week, or month. In certain implementations, hazardous locations may be identified based on a rate of occurrence for anomalous vehicle operations 658 associated with locations 652C in the mapping database. For example, hazardous locations may be identified based on a proportion of vehicles operating near a location 608 that experience an anomalous vehicle operation 658. In still further implementations, the hazardous locations may be identified based on a type of anomalous vehicle operation 658 and/or a severity of anomalous vehicle operation 658 stored in association with the location 652C. For example, even if the absolute occurrence of anomalous vehicle operations 658 stored in association with a location 652C is low, the location 652C may still be identified as a hazardous location if the associated anomalous vehicle operations 658 are severe (e.g., severe acceleration or severe deceleration events).

The server 602 may then generate the route 618 to avoid hazardous locations (block 818). For example, the server 602 may generate the route 618 to avoid the identified hazardous locations by a certain minimum distance (e.g., 100 feet, 100 yards, one city block). In certain implementations, one or both of the first location 614 in the second location 616 may be identified as a hazardous location and/or may be located near a hazardous location. Accordingly, the route 618 may be generated using a different starting point than the first location 614 (e.g., when the first location 614 is located at or near a hazardous location) and/or using a different ending point than the second location 616 (e.g., when the second location 616 is located at or near a hazardous location).

By incorporating and analyzing anomalous vehicle operation 658 as they occur over time, the server 602, by performing the method 810, may be able to improve the safety of vehicle operators and passengers by avoiding locations prone to hazards and/or dangerous conditions. The method 810 may therefore increase the safety of vehicles that are operated along routes 618 that are generated by the server 602.

Figure 9:
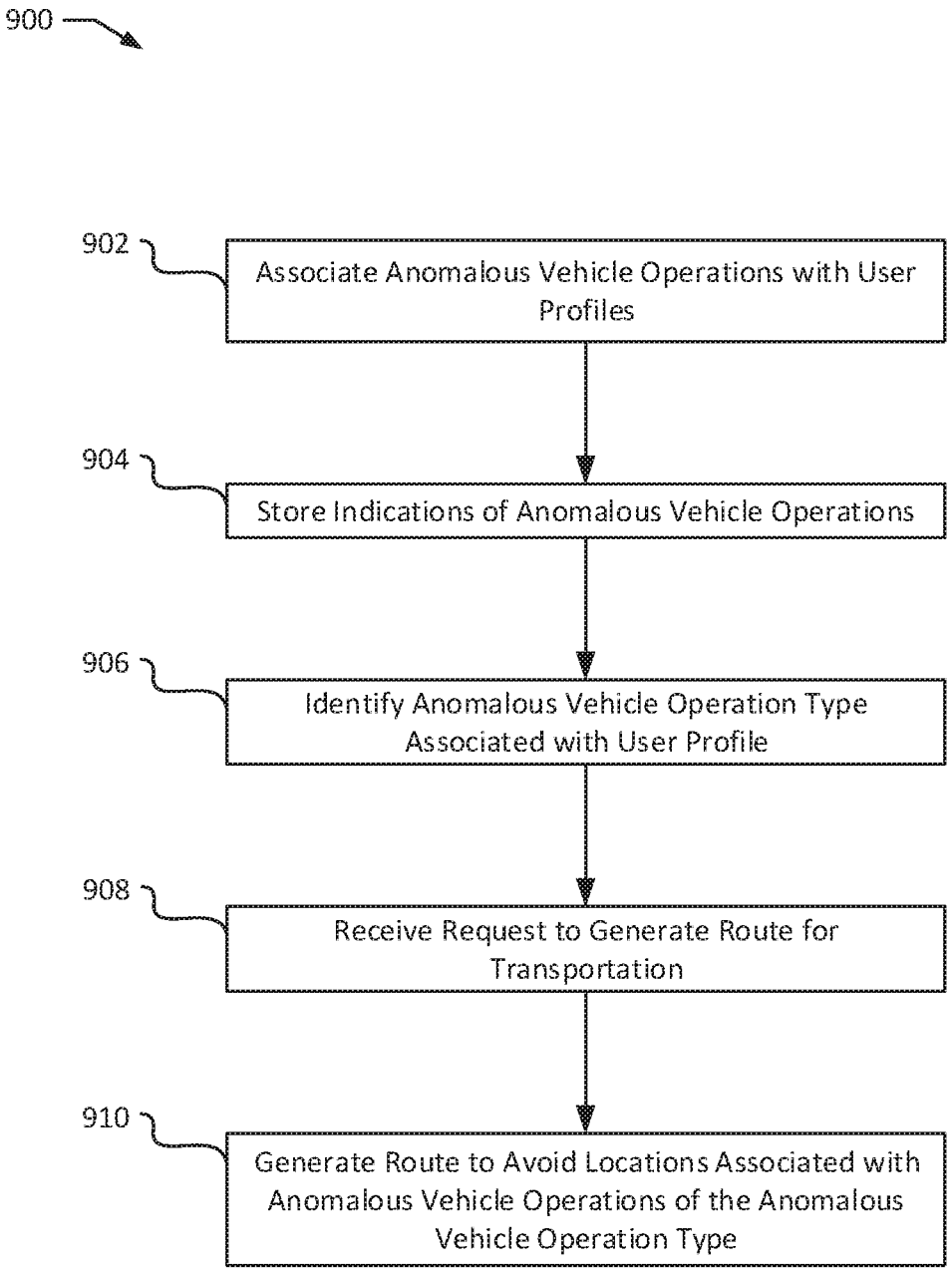
FIG. 9 illustrates a method according to an exemplary embodiment of the present disclosure.

FIG. 9 depicts a method 900 according to an exemplary embodiment of the present disclosure. The method 900 may be performed to receive and process telematics indicators 632 in order to associate anomalous vehicle operations 622 with corresponding user profiles 620 and to generate routes for those user profiles that take associated anomalous vehicle operations 622 into account. The method 900 may be implemented on a computer system, such as the system 600. For example, the method 900 may be implemented by the server 602, the telematics database 630, routing information database 640, the mapping database 650, and the user database 660. The method 900 may also be implemented by a set of instructions stored on a computer readable medium that, when executed by a processor, cause the computer system to perform the method 900. For example, all or part of the method 900 may be implemented by the processor 626 and the memory 628. Although the examples below are described with reference to the flowchart illustrated in FIG. 9, many other methods of performing the acts associated with FIG. 9 may be used. For example, the order of some of the blocks may be changed, certain blocks may be combined with other blocks, one or more of the blocks may be repeated, and some of the blocks described may be optional. In certain implementations, the method 900 may be performed in conjunction with the method 700. For example, the method 900 may be performed after identifying anomalous vehicle operations at block 704. In certain implementations, the method 900 performed independent of the method 700. For example, the server 602 and perform blocks 702 and 704 of the method 700 and proceed with executing the method 900 without completing execution of the method 700 (e.g., without performing blocks 706 and 708).

The method 900 may begin with associating anomalous vehicle operations 622 with user profiles 620 (block 902). The server 602 may associate the anomalous vehicle operation 622 with user profiles 620 based on the user information provided in connection with the telematics indicators 632 corresponding to identified anomalous vehicle operations 622. For example, the telematics indicators 632 may be stored in association with a user profile of an operator of the vehicle 634 in the telematics database 630 (not depicted). In other implementations, the server 602 may identify a user profile 662A associated with the same vehicle in the user database 660 as the telematics indicator 632 is associated with in the telematics database 630. The telematics indicators 632 may be stored in accordance with a user setting specifying a predetermined period of time (e.g., a day, a week, a month) for which the information can be stored. After the predetermined period of time has passed, the telematics indicators 632 may be deleted. Additionally, the anomalous vehicle operation 622 may be associated with the user profiles 620 according to one or more user settings (e.g., user settings allowing or prohibiting such associations to be formed).

The server 602 may then store indications of the anomalous vehicle operations (block 904). The server 602 may store indications of anomalous vehicle operation 622 in association with user profiles 620 in a user database 660. For example, the server 602 may store the anomalous vehicle operation 622 in association with the user profile 620 as depicted for the user profile 662B in the anomalous vehicle operation 666 in the user database 660. The indications of the anomalous vehicle operations 622 may be stored in accordance with a user setting specifying a predetermined period of time (e.g., a day, a week, a month) for which the information can be stored. After the predetermined period of time has passed, the indications of the anomalous vehicle operations 622 may be deleted.

The server 602 may then identify anomalous vehicle operation types associated with a particular user profile (block 906). The server 602 may analyze associations between user profiles 662B and anomalous vehicle operations 666 from the user database 660 to identify the anomalous vehicle operation type. The server 602 may analyze these associations in compliance with user settings associated with the particular user profile (e.g., allowing the server to perform such analysis). Abnormal vehicle operation types may be identified based on anomalous vehicle operations 666 of the same type (e.g., hard braking, hard acceleration, fast cornering, high-speed, phone handling during vehicle operation). In particular, anomalous vehicle operation types may be identified if a predetermined number of anomalous vehicle operations 666 (e.g., 10 operations, 50 operations, 100 operations) are associated with the same user profile 662B. In certain implementations, the server 602 may identify anomalous vehicle operation types based on anomalous vehicle operations 666 that have occurred during a predetermined time interval (e.g., the preceding week, the preceding month, the preceding six months, the preceding year). In certain implementations, the anomalous vehicle operation types may be determined by one or more heuristics and/or predictive models. In certain implementations, the anomalous vehicle operation type may be stored in association with the user profile 662 (e.g., a user database 660).

The server 602 may then receive a request 612 to generate a route for transportation (block 908). As discussed further above in connection with block 812, the request 612 may specify a first location 614 and a second location 616 and may be requesting transportation between the first and second locations 614, 616.

The server 602 may then generate a route 618 to avoid locations 652C associated with anomalous vehicle operations 658 of the anomalous vehicle operation type (block 910). For example, the server 602 may generate a route 618 for fulfillment by a vehicle operator with a user profile in the user database 660. The server 602 may query the user database 660 for anomalous vehicle operation types associated with the user profile of the vehicle operator. The server 602 may then identify locations between the first and second locations 614, 616 within the mapping database 650 that correspond to anomalous vehicle operations 658 of the anomalous vehicle operation type. This identification procedure may be similar to that discussed above in connection with blocks 814 and 816 for identifying hazardous locations. A location 652C may be identified as associated with an anomalous vehicle operation 658 of the anomalous vehicle operation type if the location 652C is associated with a predetermined number of such anomalous vehicle operations 658 (e.g., 5 operations, 10 operations, 100 operations). In other implementations, the location 652C may be identified as associated with anomalous vehicle operations 658 of the anomalous vehicle operation type if a certain percentage of anomalous vehicle operations 658 associated with the location 652C are of the anomalous vehicle operation type (e.g., 2%, 5%, 10%, 50%). Once the locations 652C associated with anomalous vehicle operation 658 the anomalous vehicle operation type are identified, the server 602 may generate the route 618 to avoid such locations 652C. The server 602 may generate the route 618 to avoid these locations 652C in a manner similar to that discussed above in connection with generating a route 618 at block 818.

By generating the route 618 to avoid anomalous vehicle operation 658 frequently associated with the vehicle operator, the server 602 may be able to personalize routes 618 for individual operators. In particular, by avoiding such anomalous vehicle operations 658, the routes 618 may be safer for operation by the vehicle operator. These routes 618 may therefore improve safety both for the vehicle operator and for passengers and other individuals near the vehicle.

Figure 10:
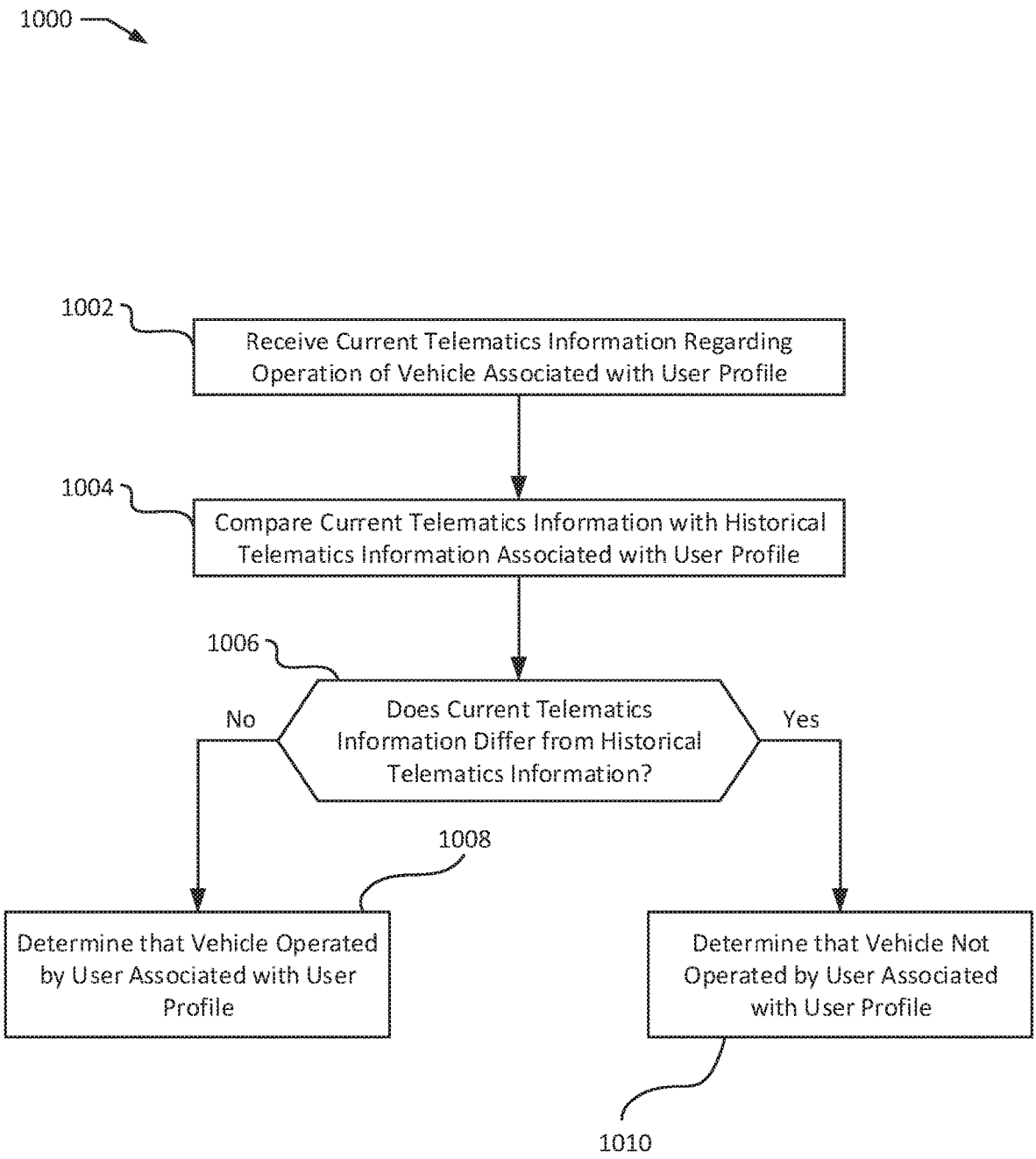
FIG. 10 illustrates a method according to an exemplary embodiment of the present disclosure.

FIG. 10 depicts a method 1000 according to an exemplary embodiment of the present disclosure. The method 1000 may be performed to utilize current telematics information 624 to verify whether an individual operating a vehicle is the same as indicated by a user profile associated with the vehicle. The method 1000 may be implemented on a computer system, such as the system 600. For example, the method 1000 may be implemented by the server 602, the telematics database 630, the routing information database 640, the mapping database 650, and the user database 660. The method 1000 may also be implemented by a set of instructions stored on a computer readable medium that, when executed by a processor, cause the computer system to perform the method. For example, all or part of the method 1000 may be implemented by the processor 626 and the memory 628. Although the examples below are described with reference to the flowchart illustrated in FIG. 10, many other methods of performing the acts associated with FIG. 10 may be used. For example, the order of some of the blocks may be changed, certain blocks may be combined with other blocks, one or more of the blocks may be repeated, and some of the blocks described may be optional. In certain implementations, the method 1000 may be performed in conjunction with the method 900. For example, the method 1000 may be performed after storing indications of anomalous vehicle operations 666 at block 904. In certain implementations, the method 1000 may be performed independent of the method 900. For example, the server 602 and perform blocks 902 and 904 of the method 900 and proceed with executing the method 1000 without completing execution of the method 900 (e.g., without performing blocks 906, 908, 910).

The method 1000 begins with receiving current telematics information 624 regarding operation of a vehicle associated with the user profile (block 1002). The current telematics information 624 may be received from a telematics device associated with the vehicle (e.g., the primary device 130 and/or a secondary device 150). The current telematics information 624 may additionally or alternatively be received from a database communicatively coupled to such a telematics device (e.g., a database storing real-time or near real-time telematics information). The current telematics information 624 may be received in compliance with one or more user settings (e.g., user settings associated with the user profile) indicating that receiving the current telematics information 624 is allowed. The current telematics information 624 may include telematics information similar to that provided by the telematics indicator 632 (e.g., one or more of acceleration information regarding the vehicle, speed information regarding the vehicle, location information regarding the vehicle). A user profile associated with the vehicle for which current telematics information 624 is received may be determined based on the user database 660. For example, the current telematics information 624 may be received in association with an identifier of the vehicle (e.g., the vehicle 664) to which the current telematics information 624 corresponds. The server 602 may then query the user database 660 for a user profile 662A stored in association with the indicated vehicle 664 to determine the associated user.

The server 602 may then compare the current telematics information 624 historical telematics information associated with the user profile 662 (block 1004). In particular, the server 602 may compare the current telematics information 624 with telematics information stored in association with the user profile 662A in the user database 660. For example, the user database 660 may store anomalous vehicle operations 666 and/or other telematics information (e.g., telematics indicators 632) in association with the user profile 662A (e.g., may store anomalous vehicle operations 666 and/or other telematics information in compliance with user preferences associated with the user profiles 662A-B specifying a predetermined period of time for which information can be stored). The server 602 may compare the current telematics information 624 with such telematics information from the user database 660. In performing the comparison, the server 602 may use one or more heuristics and/or a predictive model. For example, the server 602 may compare the occurrence frequency of certain types of anomalous vehicle operations stored in association with the user profile 662A (not depicted). In particular, the server 602 may compare how frequently the current telematics information 624 indicates hard acceleration or hard breaking events as compared to the occurrence of hard acceleration or hard braking events among the anomalous vehicle operations stored in the user database 660.

The server 602 may determine whether the current telematics information 624 differs from the historic telematics information (block 1006). In making this determination, the server 602 may identify an amount by which the current telematics information 624 differs from the historical telematics information. Continuing the previous comparison example, the server 602 may determine an amount by which the occurrence of hard acceleration events in the current telematics information differs from the occurrence of hard acceleration events in the anomalous vehicle operations 666. For example, the current telematics information 624 may indicate hard acceleration events as occurring once every 10 minutes, while the anomalous vehicle operations 666 indicate hard acceleration events as occurring once every 15 minutes. The server 602 may therefore determine, based on this difference, that the current telematics information 624 differs from the historical telematics information. However, if the current telematics information 624 indicated hard acceleration events as occurring every 14 minutes instead, reducing the difference with the historical telematics information, the server 602 may determine that the current telematics information 624 does not differ sufficiently. In certain implementations, the server 602 may consider multiple types of anomalous vehicle operations 666 and may determine that the current telematics information 624 differs if a majority of the anomalous vehicle operation types differ, or if a certain number of anomalous vehicle operation types differ. In making this determination, the server 602 may also consider telematics information other than anomalous vehicle operations 666 (e.g., other telematics indicators stored in association with the user profile 662A in compliance with user settings associated with the user profile 662A).

If the server 602 determines that the current telematics information 624 does not differ from the historical telematics information, the server 602 may determine that the vehicle 664 is operated by the user associated with the user profile 662A (block 1008). Since the expected user is determined to be operating the vehicle 664, processing may be complete.

If the server 602 determines that the current telematics information 624 differs from the historical telematics information, the server 602 may determine that the vehicle 664 is not being operated by the user associated with the user profile 662A (block 1010). For example, the server 602 may determine that another individual is operating the vehicle 664 (e.g., due to account sharing or account swapping between vehicle operators). The server 602 may then generate and present an alert to the vehicle operator (e.g., via a mobile computing device) indicating that the current vehicle operator is not the correct user associated with the user profile 662A and, e.g., suggesting that the vehicle operator log into or access an appropriate user profile. Accordingly, by detecting a different user operating the vehicle, the server 602 may be able to reduce account fraud, increase account security, and make sure that user profiles and the user database 660 are used to accurately track operations of the vehicle. This determination may be made in compliance with a user setting associated with the user profile. For example, the user setting may indicate that the server 602 is permitted to determine whether a correct user is operating the vehicle and the server 602 may therefore determine whether the vehicle is operated by the user associated with the user profile. In another example, the user setting may indicate that the server 602 is not permitted to determine whether a correct user is operating the vehicle and the server 602 may therefore not make the determination (e.g., may not perform blocks 1006, 1008, 1010).

Figure 11:
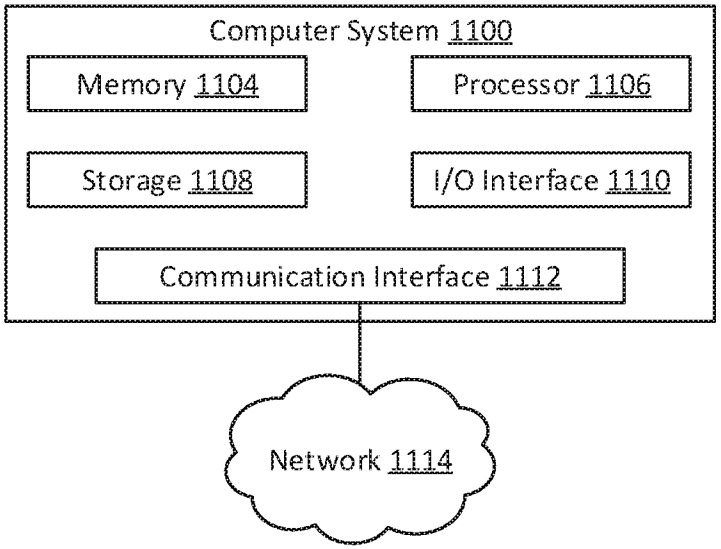
FIG. 11 illustrates a computer system according to an exemplary embodiment of the present disclosure.

FIG. 11 illustrates an example computer system 1100 that may be utilized to implement one or more of the devices and/or components of FIGS. 1 and 6, such as the server 102, the primary device 130, the secondary device, the routing information database 120, the server 602, the telematics database 630, the routing information database 640, the mapping database 650, and/or the user database 660. In particular embodiments, one or more computer systems 1100 perform one or more steps of one or more methods described or illustrated herein. In particular embodiments, one or more computer systems 1100 provide the functionalities described or illustrated herein. In particular embodiments, software running on one or more computer systems 1100 performs one or more steps of one or more methods described or illustrated herein or provides the functionalities described or illustrated herein. Particular embodiments include one or more portions of one or more computer systems 1100. Herein, a reference to a computer system may encompass a computing device, and vice versa, where appropriate. Moreover, a reference to a computer system may encompass one or more computer systems, where appropriate.

This disclosure contemplates any suitable number of computer systems 1100. This disclosure contemplates the computer system 1100 taking any suitable physical form. As example and not by way of limitation, the computer system 1100 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, the computer system 1100 may include one or more computer systems 1100; be unitary or distributed; span multiple locations; span multiple machines; span multiple data centers; or reside in a cloud, which may include one or more cloud components in one or more networks. Where appropriate, one or more computer systems 1100 may perform without substantial spatial or temporal limitation one or more steps of one or more methods described or illustrated herein. As an example and not by way of limitation, one or more computer systems 1100 may perform in real time or in batch mode one or more steps of one or more methods described or illustrated herein. One or more computer systems 1100 may perform at different times or at different locations one or more steps of one or more methods described or illustrated herein, where appropriate.

In particular embodiments, computer system 1100 includes a processor 1106, memory 1104, storage 1108, an input/output (I/O) interface 1110, and a communication interface 1112. Although this disclosure describes and illustrates a particular computer system having a particular number of particular components in a particular arrangement, this disclosure contemplates any suitable computer system having any suitable number of any suitable components in any suitable arrangement.

In particular embodiments, the processor 1106 includes hardware for executing instructions, such as those making up a computer program. As an example and not by way of limitation, to execute instructions, the processor 1106 may retrieve (or fetch) the instructions from an internal register, an internal cache, memory 1104, or storage 1108; decode and execute the instructions; and then write one or more results to an internal register, internal cache, memory 1104, or storage 1108. In particular embodiments, the processor 1106 may include one or more internal caches for data, instructions, or addresses. This disclosure contemplates the processor 1106 including any suitable number of any suitable internal caches, where appropriate. As an example and not by way of limitation, the processor 1106 may include one or more instruction caches, one or more data caches, and one or more translation lookaside buffers (TLBs). Instructions in the instruction caches may be copies of instructions in memory 1104 or storage 1108, and the instruction caches may speed up retrieval of those instructions by the processor 1106. Data in the data caches may be copies of data in memory 1104 or storage 1108 that are to be operated on by computer instructions; the results of previous instructions executed by the processor 1106 that are accessible to subsequent instructions or for writing to memory 1104 or storage 1108; or any other suitable data. The data caches may speed up read or write operations by the processor 1106. The TLBs may speed up virtual-address translation for the processor 1106. In particular embodiments, processor 1106 may include one or more internal registers for data, instructions, or addresses. This disclosure contemplates the processor 1106 including any suitable number of any suitable internal registers, where appropriate. Where appropriate, the processor 1106 may include one or more arithmetic logic units (ALUs), be a multi-core processor, or include one or more processors 1102. Although this disclosure describes and illustrates a particular processor, this disclosure contemplates any suitable processor.

In particular embodiments, the memory 1104 includes main memory for storing instructions for the processor 1106 to execute or data for processor 1106 to operate on. As an example, and not by way of limitation, computer system 1100 may load instructions from storage 1108 or another source (such as another computer system 1100) to the memory 1104. The processor 1106 may then load the instructions from the memory 1104 to an internal register or internal cache. To execute the instructions, the processor 1106 may retrieve the instructions from the internal register or internal cache and decode them. During or after execution of the instructions, the processor 1106 may write one or more results (which may be intermediate or final results) to the internal register or internal cache. The processor 1106 may then write one or more of those results to the memory 1104. In particular embodiments, the processor 1106 executes only instructions in one or more internal registers or internal caches or in memory 1104 (as opposed to storage 1108 or elsewhere) and operates only on data in one or more internal registers or internal caches or in memory 1104 (as opposed to storage 1108 or elsewhere). One or more memory buses (which may each include an address bus and a data bus) may couple the processor 1106 to the memory 1104. The bus may include one or more memory buses, as described in further detail below. In particular embodiments, one or more memory management units (MMUs) reside between the processor 1106 and memory 1104 and facilitate accesses to the memory 1104 requested by the processor 1106. In particular embodiments, the memory 1104 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 1104 may include one or more memories 1104, where appropriate. Although this disclosure describes and illustrates particular memory implementations, this disclosure contemplates any suitable memory implementation.

In particular embodiments, the storage 1108 includes mass storage for data or instructions. As an example and not by way of limitation, the storage 1108 may include a hard disk drive (HDD), a floppy disk drive, flash memory, an optical disc, a magneto-optical disc, magnetic tape, or a Universal Serial Bus (USB) drive or a combination of two or more of these. The storage 1108 may include removable or non-removable (or fixed) media, where appropriate. The storage 1108 may be internal or external to computer system 1100, where appropriate. In particular embodiments, the storage 1108 is non-volatile, solid-state memory. In particular embodiments, the storage 1108 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 1108 taking any suitable physical form. The storage 1108 may include one or more storage control units facilitating communication between processor 1106 and storage 1108, where appropriate. Where appropriate, the storage 1108 may include one or more storages 806. Although this disclosure describes and illustrates particular storage, this disclosure contemplates any suitable storage.

In particular embodiments, the I/O Interface 1110 includes hardware, software, or both, providing one or more interfaces for communication between computer system 1100 and one or more I/O devices. The computer system 1100 may include one or more of these I/O devices, where appropriate. One or more of these I/O devices may enable communication between a person and computer system 1100. As an example and not by way of limitation, an I/O device may include a keyboard, keypad, microphone, monitor, screen, display panel, mouse, printer, scanner, speaker, still camera, stylus, tablet, touch screen, trackball, video camera, another suitable I/O device or a combination of two or more of these. An I/O device may include one or more sensors. Where appropriate, the I/O Interface 1110 may include one or more device or software drivers enabling processor 1106 to drive one or more of these I/O devices. The I/O interface 1110 may include one or more I/O interfaces 1110, where appropriate. Although this disclosure describes and illustrates a particular I/O interface, this disclosure contemplates any suitable I/O interface or combination of I/O interfaces.

In particular embodiments, communication interface 1112 includes hardware, software, or both providing one or more interfaces for communication (such as, for example, packet-based communication) between computer system 1100 and one or more other computer systems 1100 or one or more networks 1114. As an example and not by way of limitation, communication interface 1112 may include a network interface controller (NIC) or network adapter for communicating with an Ethernet or any other wire-based network or a wireless NIC (WNIC) or wireless adapter for communicating with a wireless network, such as a Wi-Fi network. This disclosure contemplates any suitable network 1114 and any suitable communication interface 1112 for it. As an example and not by way of limitation, the network 1114 may include one or more of an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 1100 may communicate with a wireless PAN (WPAN) (such as, for example, a Bluetooth® WPAN), a WI-FI network, a WI-MAX network, a cellular telephone network (such as, for example, a Global System for Mobile Communications (GSM) network), or any other suitable wireless network or a combination of two or more of these. Computer system 1100 may include any suitable communication interface 1112 for any of these networks, where appropriate. Communication interface 1112 may include one or more communication interfaces 1112, where appropriate. Although this disclosure describes and illustrates a particular communication interface implementations, this disclosure contemplates any suitable communication interface implementation.

The computer system 1100 may also include a bus. The bus may include hardware, software, or both and may communicatively couple the components of the computer system 1100 to each other. As an example and not by way of limitation, the bus may include an Accelerated Graphics Port (AGP) or any other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. The bus may include one or more buses, where appropriate. Although this disclosure describes and illustrates a particular bus, this disclosure contemplates any suitable bus or interconnect.

Herein, a computer-readable non-transitory storage medium or media may include one or more semiconductor-based or other types of integrated circuits (ICs) (e.g., field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Example methods and systems are described herein. Any example embodiment or feature described herein is not necessarily to be construed as preferred or advantageous over other embodiments or features. The example embodiments described herein are not meant to be limiting. It will be readily understood that certain aspects of the disclosed systems and methods can be arranged and combined in a wide variety of different configurations, all of which are contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an example embodiment may include elements that are not illustrated in the Figures.

It should be understood that various changes and modifications to the examples described here will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A system comprising:

at least one processor; and at least one non-transitory computer readable storage medium storing instructions that, when executed by the at least one processor, cause the system to:

obtain telematics information from a first device associated with a vehicle, the telematics information indicating operations of the vehicle;

determine, based on the telematics information, first anomalous operation of the vehicle;

determine whether the first anomalous operation of the vehicle is a vehicle collision;

in response to determining the first anomalous operation of the vehicle is not a vehicle collision:

identifying a user profile associated with an operator of the vehicle; and storing an indication of the first anomalous operation of the vehicle, wherein the indication associates the first anomalous operation of the vehicle with the user profile;

determine, based on the telematics information, a second anomalous operation of the vehicle; and in response to determining the second anomalous operation of the vehicle is a vehicle collision:

receive routing information for the vehicle, the routing information identifying previous locations of the vehicle; and compare the routing information with the telematics information to identify a location of the vehicle collision.

2. The system of claim 1, while further comprising instructions that, when executed by the at least one processor, cause the system to:

identify an indicator of the vehicle collision for the second anomalous operation within the telematics information; and correlate a time stamp of the indicator of the vehicle collision for the second anomalous operation with the routing information.

3. The system of claim 1, further comprising instructions that, when executed by the at least one processor, cause the system to:

receive second telematics information from a second device associated with the vehicle; and validate the telematics information from the first device with the second telematics information.

4. The system of claim 3, further comprising instructions that, when executed by the at least one processor, cause the system to:

correlate timing information of the telematics information received from the first device with timing information of the second telematics information received from the second device; and validate the second anomalous operation of the vehicle by comparing the telematics information with the second telematics information.

5. The system of claim 1, further comprising instructions that, when executed by the at least one processor, cause the system to:

determine whether the second anomalous operation of the vehicle is at least one of a hard acceleration event, a hard braking event, a fast cornering event, or a device handling event during operation of the vehicle.

6. A method comprising:

obtaining telematics information from a first device associated with a vehicle, the telematics information indicating operations of the vehicle;

determining, based on the telematics information, first anomalous operation of the vehicle;

determining whether the first anomalous operation of the vehicle is a vehicle collision;

in response to determining the first anomalous operation of the vehicle is not a vehicle collision:

identifying a user profile associated with an operator of the vehicle; and storing an indication of the first anomalous operation of the vehicle, wherein the indication associates the first anomalous operation of the vehicle with the user profile;

determining, based on the telematics information, a second anomalous operation of the vehicle; and in response to determining the second anomalous operation of the vehicle is a vehicle collision:

receiving routing information for the vehicle, the routing information identifying previous locations of the vehicle; and comparing the routing information with the telematics information to identify a location of the vehicle collision.

7. The method of claim 6, wherein storing an indication of the first anomalous operation of the vehicle further comprises: storing the indication of the first anomalous operation until a predetermined period has passed.

8. The method of claim 6, wherein comparing the routing information with the telematics information further comprises:

identifying an indicator of the vehicle collision for the second anomalous operation within the telematics information; and correlating a time stamp of the indicator of the vehicle collision for the second anomalous operation with the routing information.

9. The method of claim 6, further comprising:

receiving second telematics information from a second device associated with the vehicle; and validating the telematics information from the first device with the second telematics information.

10. The method of claim 9, wherein validating the telematics information from the first device further comprises:

correlating timing information of the telematics information received from the first device with timing information of the second telematics information received from the second device; and validating the second anomalous operation of the vehicle by comparing the telematics information with the second telematics information.

11. The method of claim 6, further comprising: determining whether the second anomalous operation of the vehicle is at least one of a hard acceleration event, a hard braking event, a fast cornering event, or a device handling event during operation of the vehicle.

12. A non-transitory, computer-readable medium storing instructions thereon that, when executed by at least one processor, cause a computing device to:

obtain telematics information from a first device associated with a vehicle, the telematics information indicating operations of the vehicle;

determine, based on the telematics information, first anomalous operation of the vehicle;

determine whether the first anomalous operation of the vehicle is a vehicle collision;

in response to determining the first anomalous operation of the vehicle is not a vehicle collision:

identifying a user profile associated with an operator of the vehicle; and storing an indication of the first anomalous operation of the vehicle, wherein the indication associates the first anomalous operation of the vehicle with the user profile;

determine, based on the telematics information, a second anomalous operation of the vehicle; and in response to determining the second anomalous operation of the vehicle is a vehicle collision:

receive routing information for the vehicle, the routing information identifying previous locations of the vehicle; and compare the routing information with the telematics information to identify a location of the vehicle collision.

13. The non-transitory, computer-readable medium of claim 12, further comprising instructions that, when executed by the at least one processor, cause the computing device to: store the indication of the first anomalous operation until a predetermined period has passed.

14. The non-transitory, computer-readable medium of claim 12, further comprising instructions that, when executed by the at least one processor, cause the computing device to:

identify an indicator of the vehicle collision for the second anomalous operation within the telematics information; and correlate a time stamp of the indicator of the vehicle collision for the second anomalous operation with the routing information.

15. The non-transitory, computer-readable medium of claim 12, further comprising instructions that, when executed by the at least one processor, cause the computing device to:

receive second telematics information from a second device associated with the vehicle; and validate the telematics information from the first device with the second telematics information.

16. The non-transitory, computer-readable medium of claim 15, further comprising instructions that, when executed by the at least one processor, cause the computing device to: further comprising instructions that, when executed by the at least one processor, cause the computing device to:

correlate timing information of the telematics information received from the first device with timing information of the second telematics information received from the second device; and validate the second anomalous operation of the vehicle by comparing the telematics information with the second telematics information.

17. The non-transitory, computer-readable medium of claim 12, further comprising instructions that, when executed by the at least one processor, cause the computing device to:

receive a request to generate a route in connection with a request for transportation between a first location and a second location and generating the route by:

determining that at least one of the first location and the second location is within a threshold distance of the location of the vehicle collision of the second anomalous operation; and generating the route to include a starting location or destination location that avoids the location of the vehicle collision.

18. A method, comprising:

generating a task for a transportation provider vehicle in a dynamic transportation network;

retrieving first telematics information from a computing device of the transportation provider vehicle based at least on the task;

identifying one or more anomalous operations of the transportation provider vehicle based at least on the first telematics information;

determining whether the one or more anomalous operations of the transportation provider vehicle is a vehicle collision;

in response to determining the one or more anomalous operations of the transportation provider vehicle is not a vehicle collision:

identifying a user profile associated with an operator of the transportation provider vehicle; and storing an indication of the one or more anomalous operations of the transportation provider vehicle, wherein the indication associates the one or more anomalous operations of the transportation provider vehicle with the user profile;

generating a notification based at least on the one or more anomalous operations; and transmitting the notification to the computing device to cause the computing device to display the notification.

19. The method of claim 18, further comprising:

identifying the one or more anomalous operations indicates a collision associated with the transportation provider vehicle;

retrieving second telematics information from one or more additional computing devices located within a threshold distance from the transportation provider vehicle;

generating the notification to indicating the collision with the transportation provider vehicle, and transmit the notification to the one or more additional computing devices indicating the collision to cause the one or more additional computing devices to display the notification indicating the collision.

20. The method of claim 19, further comprising:

identifying that one or more anomalous operations of the transportation provider vehicle corresponds to one or more locations in completion of the task with the transportation provider vehicle;

storing the one or more locations in association with the one or more anomalous operations of the transportation provider vehicle;

generating the notification comprising a warning notification identifying the one or more locations associated with the one or more anomalous operations; and transmitting the warning notification to one or more additional computing device in response to the transportation provider vehicle being located within a threshold distance from the one or more locations.

* * * * *